US007367645B2

(12) United States Patent
Nunokawa

(10) Patent No.: US 7,367,645 B2
(45) Date of Patent: May 6, 2008

(54) PRINTING METHOD AND PRINTING APPARATUS

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 10/936,814

(22) Filed: Sep. 9, 2004

(65) Prior Publication Data

US 2005/0088472 A1 Apr. 28, 2005

(30) Foreign Application Priority Data

Sep. 10, 2003 (JP) ..... 2003-318724

(51) Int. Cl.
*B41J 29/38* (2006.01)

(52) U.S. Cl. ..... 347/16

(58) Field of Classification Search ..... 347/16, 347/19

See application file for complete search history.

(56) References Cited

U.S. PATENT DOCUMENTS 5,239,312 A * 8/1993 Merna et al. ..... 347/41
6,250,734 B1 * 6/2001 Otsuki ..... 347/16
6,866,358 B2 * 3/2005 Masuyama et al. ..... 347/14
6,935,715 B2 * 8/2005 Bates et al. ..... 347/16

FOREIGN PATENT DOCUMENTS

JP 11-268344 A 10/1999
JP 2002-103582 A 4/2002

* cited by examiner

*Primary Examiner*—Julian D. Huffman
*Assistant Examiner*—Jason Uhlenhake
(74) *Attorney, Agent, or Firm*—Sughrue Mion, PLLC

(57) ABSTRACT

A printing method for printing an image on a medium, includes: performing a first printing process, wherein in the first printing process, the medium is carried in a carrying direction by a predetermined carry amount and an image is printed on the medium positioned at a print region, and wherein a carrying member used for carrying the medium is positioned upstream in the carrying direction with respect to the print region; and selecting the first printing process or a second printing process according to a position of a rear edge of the image on the medium as the printing process for printing the rear edge of the image on the medium, wherein in the second printing process, the medium is carried by a carry amount smaller than the carry amount of the first printing process and the image is printed on the medium positioned at the print region.

12 Claims, 21 Drawing Sheets

PRINTING METHOD AND PRINTING APPARATUS

CROSS-REFERENCE TO RELATED APPLICATIONS

The present application claims priority upon Japanese Patent Application No. 2003-318724 filed on Sep. 10, 2003, which is herein incorporated by reference.

BACKGROUND OF THE INVENTION

1. Field of the Invention

The present invention relates to printing methods and printing apparatuses.

2. Description of the Related Art

There are known printing apparatuses that can perform a first printing process, in which paper is carried by a predetermined carry amount to print an image on the paper, and a second printing process, in which the paper is carried by a carry amount that is different from the carry amount of the first printing process to print an image on the paper. (Refer, for example, to JP 11-268344A.)

When the paper is carried by a carrying member that is positioned on the upstream side in the carrying direction with respect to the print region, the quality of the printed image varies depending on whether or not the rear edge of the paper passes the carrying member during printing. On the other hand, the quality of the printed image also varies depending on whether or not the carry amount changes during printing.

SUMMARY OF THE INVENTION

It is an object of the present invention to achieve high-quality printing by determining whether or not the rear edge of the paper passes the carrying member to select a printing process.

According to an aspect of the present invention, a printing method for printing an image on a medium, includes the steps of:

performing a first printing process, wherein in the first printing process, the medium is carried in a carrying direction by a predetermined carry amount and an image is printed on the medium that is positioned at a print region, and wherein a carrying member used for carrying the medium is positioned upstream in the carrying direction with respect to the print region; and selecting either the first printing process or a second printing process according to a position of a rear edge of the image on the medium as the printing process for printing the rear edge of the image on the medium, wherein in the second printing process, the medium is carried by a carry amount that is smaller than the carry amount of the first printing process and the image is printed on the medium that is positioned at the print region.

Features and objects of the present invention other than the above will become clear by reading the description of the present specification with reference to the accompanying drawings.

BRIEF DESCRIPTION OF THE DRAWINGS

In order to facilitate a more complete understanding of the present invention and the advantages thereof, reference is now made to the following description taken in conjunction with the accompanying drawings wherein.

DETAILED DESCRIPTION OF THE INVENTION

Figure 1:
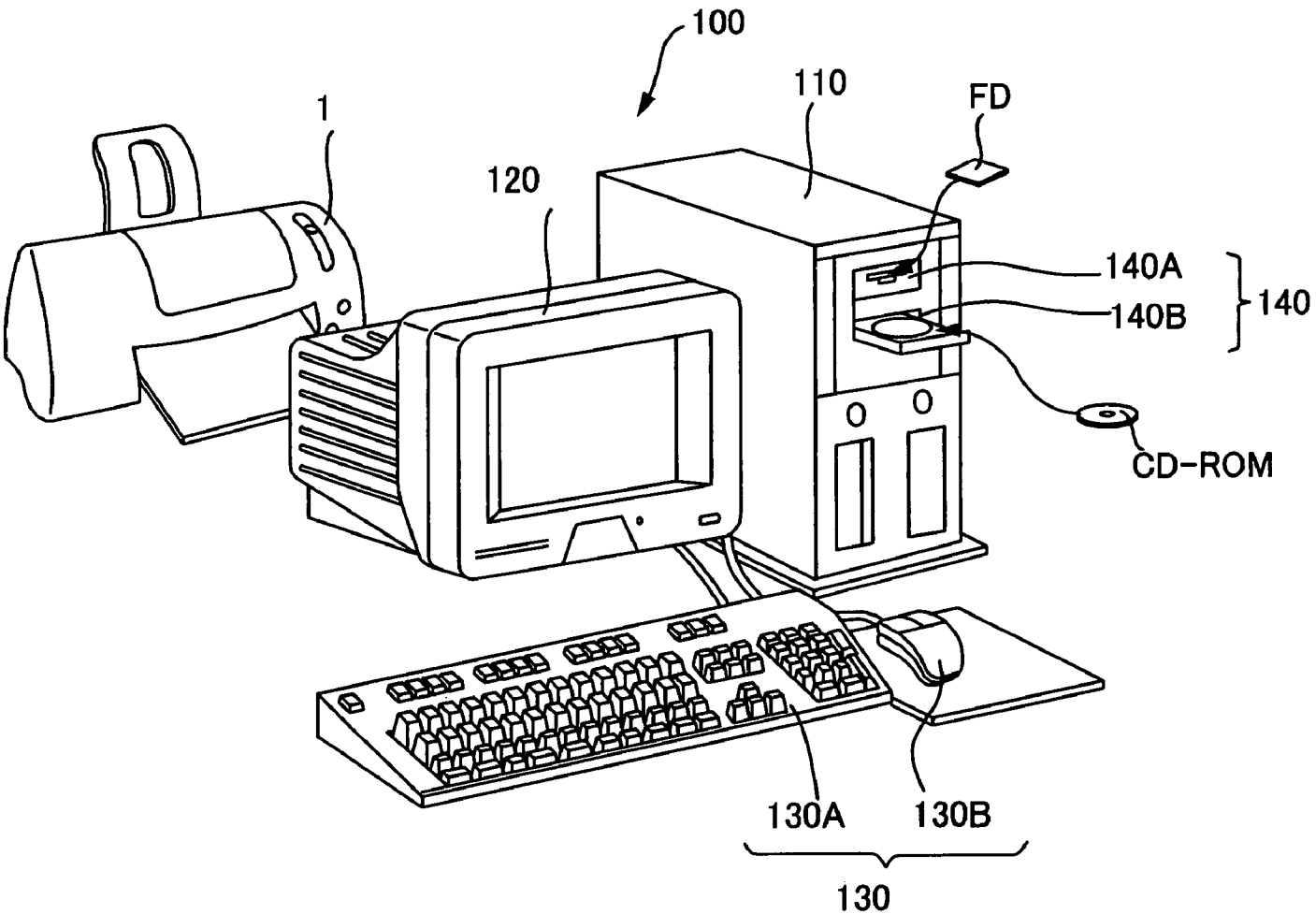
FIG. 1 is an explanatory diagram of an overall configuration of a printing system.

At least the following matters will be made clear by the explanation in the present specification and the description of the accompanying drawings.

An aspect of the present invention is a printing method for printing an image on a medium, including the steps of:

performing a first printing process, wherein in the first printing process, the medium is carried in a carrying direction by a predetermined carry amount and an image is printed on the medium that is positioned at a print region, and wherein a carrying member used for carrying the medium is positioned upstream in the carrying direction with respect to the print region; and selecting either the first printing process or a second printing process according to a position of a rear edge of the image on the medium as the printing process for printing the rear edge of the image on the medium, wherein in the second printing process, the medium is carried by a carry amount that is smaller than the carry amount of the first printing process and the image is printed on the medium that is positioned at the print region.

With this printing method, it is possible to perform high-quality printing.

In the foregoing printing method, it is preferable that, if the position of the rear edge of the image on the medium is further downstream in the carrying direction than a first position, then the first printing process is selected as the printing process for printing the rear edge of the image on the medium. In this way, it is possible to perform printing with a constant carry amount, because the rear edge of the medium does not pass the carrying member when printing is finished even when performing only the first printing process.

In the foregoing printing method, it is preferable that, if the position of the rear edge of the image on the medium is further upstream in the carrying direction than the first position and further downstream in the carrying direction than a second position, then the second printing process is selected as the printing process for printing the rear edge of the image on the medium. In this way, although the rear edge of the medium passes the carrying member during printing when only the first printing process is performed, but if a transition is made to the second printing process during printing, then the rear edge of the medium does not pass the carrying member when printing is finished. As a result, it is possible to perform high-quality printing.

In the foregoing printing method, it is preferable that, if the position of the rear edge of the image on the medium is further upstream in the carrying direction than the second position, then the first printing process is selected as the printing process for printing the rear edge of the image on the medium. Since the rear edge of the paper will pass the carrying member no matter which printing process is performed, it is possible to suppress excessive deterioration of image quality by not changing the carry amount and performing printing with a constant carry amount.

In the foregoing printing method, it is preferable that the first position is a position on the medium that is in opposition to a nozzle positioned furthest downstream in the carrying direction, among a plurality of nozzles lined up in the carrying direction, when a rear edge of the medium passes the carrying member. In this way it is possible to determine whether or not the rear edge of the medium passes the carrying member.

In the foregoing printing method, it is preferable that the second position is a position on the medium that is in opposition to a nozzle positioned furthest upstream in the carrying direction, among a plurality of nozzles lined up in the carrying direction, when a rear edge of the medium passes the carrying member. In this way it is possible to determine whether or not the rear edge of the medium passes the carrying member.

In the foregoing printing method, it is preferable that, in the second printing process, the medium is carried by a carry amount equivalent to an interval, in the carrying direction, between dots formed on the medium. In this way, it is possible to perform high-quality printing.

In the foregoing printing method, it is preferable that the first printing process is an interlace printing process. In this way, although this increases the chances that the rear edge of the medium passes the carry roller, it is possible to perform high-quality printing by selecting the printing process in accordance with the circumstances.

In the foregoing printing method, it is preferable that the position of the rear edge of the image on the medium is determined according to a size of the medium.

In the foregoing printing method, it is preferable that a rear edge of the medium is detected further upstream in the carrying direction than the carrying member; and that the position of the rear edge of the image on the medium is determined according to a result of detecting the rear edge of the medium. In this way, since the timing at which the rear edge of the medium passes the carrying member is ascertained in accordance with the actual size of the paper, it is possible to ensure that the printing scheme is selected correctly.

In the foregoing printing method, it is preferable that, after a rear edge of the medium has passed the carrying member, the medium is carried in the carrying direction by a medium-discharge member positioned further downstream in the carrying direction than the print region. In this way, after the rear edge of the medium passes the carrying member, the medium is carried only by the medium-discharge member.

In the foregoing printing method, it is preferable that the medium-discharge member has a different shape than the carrying member. In such a case, there may be a large variation in the carry states before and after the rear edge of the medium passes the carrying member, causing a noticeable deterioration in image quality.

Another aspect of the present invention is a printing apparatus for printing an image on a medium, including:

a carry unit, the carry unit being provided with a carrying member positioned upstream in a carrying direction with respect to a print region, and carrying the medium in the carrying direction; and a controller, the controller performing a first printing process in which the medium is carried by the carrying member by a predetermined carry amount and an image is printed on the medium that is positioned at the print region, and selecting either the first printing process or a second printing process according to a position of a rear edge of the image on the medium as the printing process for printing the rear edge of the image on the medium, wherein in the second printing process, the medium is carried by the carrying member by a carry amount that is smaller than the carry amount of the first printing process and the image is printed on the medium that is positioned at the print region.

With this printing apparatus, it is possible to perform high-quality printing.

Configuration of Printing System

An embodiment of a printing system (computer system) is described next with reference to the drawings. It should be noted that the description of the following embodiment also includes embodiments relating to a computer program and a storage medium having recorded thereon a computer program, for example.

FIG. 1 is an explanatory drawing showing the external structure of a printing system. A printing system 100 is provided with a printer 1, a computer 110, a display device 120, an input device 130, and a recording-and-playing device 140. The printer 1 is a printing apparatus for printing images on a medium such as paper, cloth, or film. The computer 110 is electrically connected to the printer 1, and outputs print data corresponding to an image to be printed to the printer 1 in order to cause the printer 1 to print the image. The display device 120 has a display, and displays a user interface such as an application program or a printer driver. The input device 130 is, for example, a keyboard 130A and a mouse 130B, and is used to operate the application program or adjust the settings of the printer driver, for example, in accordance with the user interface that is displayed on the display device 120. A flexible disk drive device 140A and a CD-ROM drive device 140B, for example, are employed as the recording-and-playing device 140.

A printer driver is installed on the computer 110. The printer driver is a program for achieving the function of displaying the user interface on the display device 120, and in addition it also achieves the function of converting image data that have been output from the application program into print data. The printer driver is recorded on a storage medium (computer-readable storage medium) such as a flexible disk FD or a CD-ROM. Also, the printer driver can be downloaded onto the computer 110 via the Internet. It should be noted that this program is made of codes for achieving various functions.

It should be noted that "printing apparatus" in a narrow sense means the printer 1, but in a broader sense it means the system constituted by the printer 1 and the computer 110.

Printer Driver

<Regarding the Printer Driver>

Figure 2:
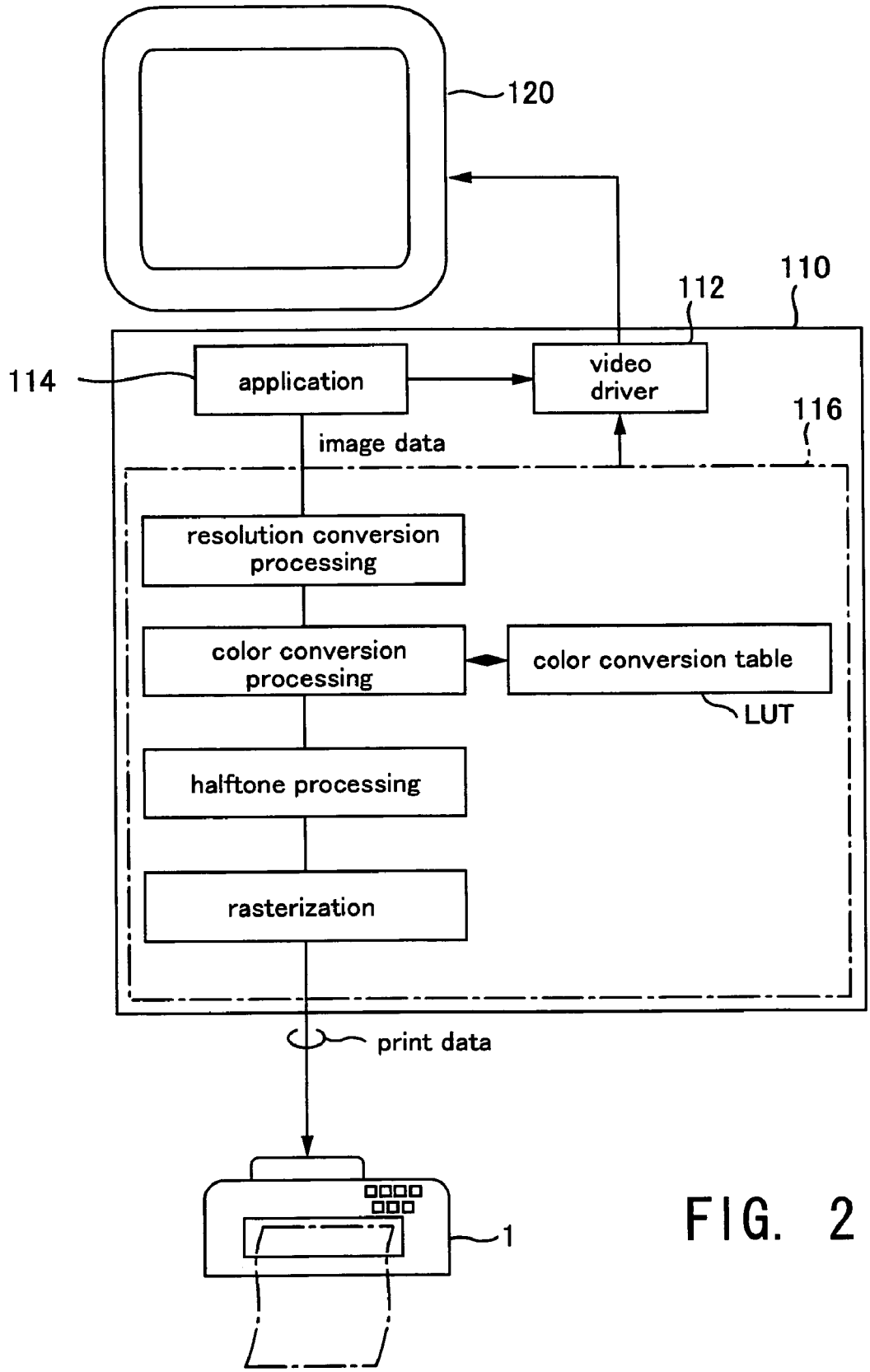
FIG. 2 is an explanatory diagram of processes carried out by a printer driver.

FIG. 2 is an explanatory diagram schematically showing basic processes carried out by a printer driver. Structural elements that have already been described are assigned identical reference numerals and thus further description thereof is omitted.

On the computer 110, computer programs such as a video driver 112, an application program 114, and a printer driver 116 operate under an operating system installed on the computer. The video driver 112 has a function of displaying, for example, the user interface on the display device 120 in accordance with display commands from the application program 114 and the printer driver 116. The application program 114, for example, has a function such as enabling image editing, and creates data (image data) related to an image. A user can give an instruction to print an image edited in the application program 114 via the user interface of the application program 114. Upon receiving the print instruction, the application program 114 outputs image data to the printer driver 116.

The printer driver 116 receives the image data from the application program 114, converts the image data to print data, and outputs print data to the printer. Here, "print data" refers to data in a format that can be interpreted by the printer 1 and that includes various command data and pixel data. Here, "command data" refers to data for instructing the printer to carry out a specific operation. Furthermore, "pixel data" refers to data related to pixels that constitute an image (print image) to be printed, and for example, it is data related to dots to be formed in positions on the paper corresponding to pixels (e.g., data about dot color and size).

In order to convert the image data that is output from the application program 114 to print data, the printer driver 116 carries out processes such as resolution conversion processing, color conversion processing, halftone processing, and rasterization. The following is a description of the processes carried out by the printer driver 116.

Resolution conversion processing is a process in which image data (text data, image data, etc.) output from the application program 114 are converted to a resolution for printing on paper. For example, when the resolution for printing an image on paper is specified as 720×720 dpi, then the image data received from the application program 114 are converted to image data of a resolution of 720×720 dpi. It should be noted that, after resolution conversion processing, the image data are multi-gradation RGB data (for example, 256 gradations) that are expressed using the RGB color space. Hereinafter, RGB data obtained by subjecting image data to resolution conversion processing are referred to as "RGB image data."

Color conversion processing is a process in which RGB data are converted to CMYK data that are expressed using a CMYK color space. It should be noted that CMYK data are data that correspond to the ink colors of the printer. The color conversion processing is carried out by the printer driver 116 referencing a table (a color conversion look-up table LUT) in which gradation values of RGB image data are associated with gradation values of CMYK image data. By this color conversion processing, RGB data for the pixels are converted to CMYK data that correspond to the ink colors. It should be noted that, after color conversion processing, the data are 256-gradation CMYK data expressed using the CMYK color space. Hereinafter, CMYK data obtained by subjecting RGB image data to color conversion processing are referred to as "CMYK image data."

Halftone processing is a process in which data of a high number of gradations are converted to data of a number of gradations that can be formed by the printer. For example, by halftone processing, data expressing 256 gradations are converted to 1-bit data expressing two gradations or 2-bit data expressing four gradations. In halftone processing, pixel data are created such that the printer can form dots dispersedly using methods such as dithering, gamma correction, and error diffusion. During halftone processing, the printer driver 116 references a dither table when performing dithering, references a gamma table when performing gamma correction, and references an error memory for storing diffused error when performing error diffusion. Halftone processed data have a resolution (for example, 720×720 dpi) equivalent to the above-mentioned RGB data. Halftone processed data are made from, for example, 1-bit or 2-bit data for each pixel. Hereinafter, 1-bit halftone processed data are referred to as "binary data", and 2-bit halftone processed data are referred to as "multi-value data".

Rasterization is a process in which image data in a matrix form are changed to data in an order suitable for transfer to the printer. Rasterized data are output to the printer as pixel data containing print data.

<Regarding the Settings of the Printer Driver>

Figure 3:
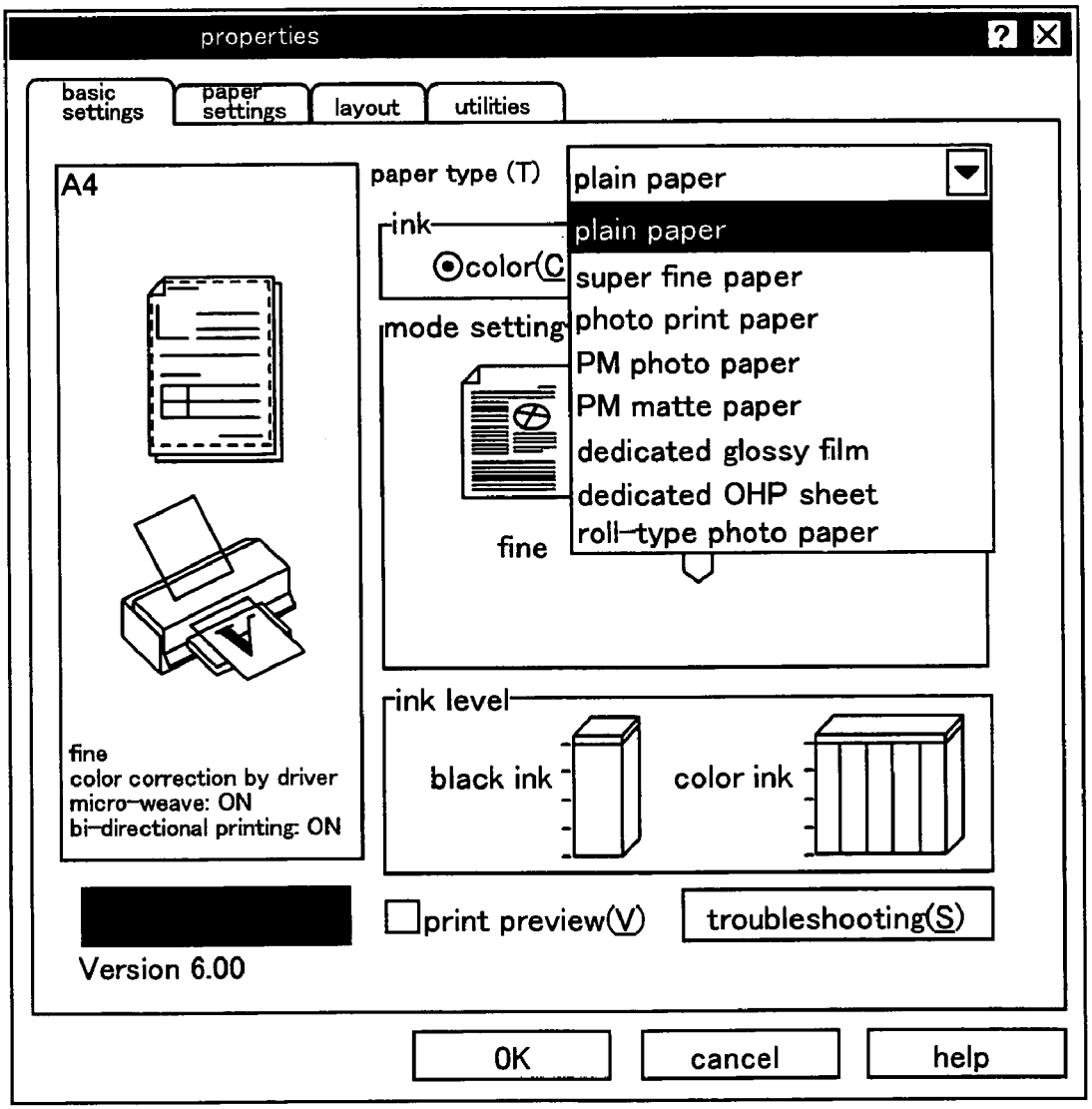
FIG. 3 is an explanatory diagram of a user interface of the printer driver.

FIG. 3 is an explanatory diagram of a user interface of the printer driver. The user interface of the printer driver is displayed on the display device via the video driver 112. The user can use the input device 130 to perform various settings of the printer driver.

The user can select the print mode from this screen. For example, the user can select a high-speed print mode or a fine print mode as the print mode. The printer driver then converts the image data to the print data such that the data is in a format corresponding to the selected print mode.

Furthermore, from this screen, the user can select the print resolution (the dot interval for printing). For example, the user can select, from this screen, 720 dpi or 360 dpi as the print resolution. The printer driver then carries out resolution conversion processing in accordance with the selected resolution and converts the image data to print data.

Furthermore, from this screen, the user can select the print paper to be used for printing. For example, the user can select plain paper or glossy paper as the print paper. Since the way an ink is absorbed and the way ink dries varies if the type of paper (paper grade) varies, the amount of ink suitable for printing also varies. For this reason, the printer driver converts image data to print data in accordance with the selected paper grade.

In this way, the printer driver converts image data to print data in accordance with conditions that are set via the user interface. It should be noted that, in addition to performing various settings of the printer driver, the user can also be notified, from this screen, of information such as the amount of ink remaining in the cartridges.

Configuration of Printer

<Regarding the Configuration of an Inkjet Printer>

Figure 4:
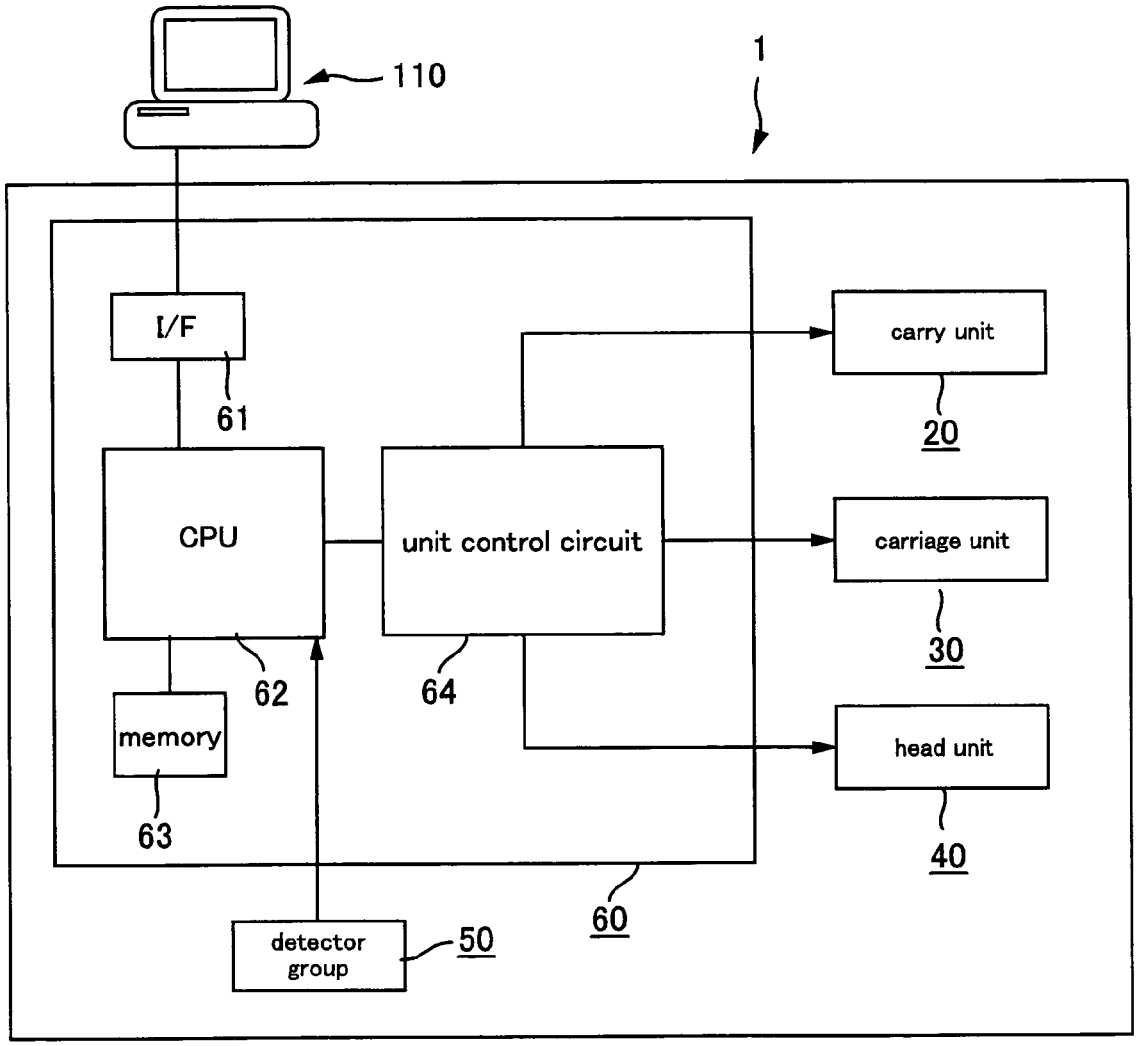
FIG. 4 is a block diagram of an overall configuration of a printer.
Figure 5:
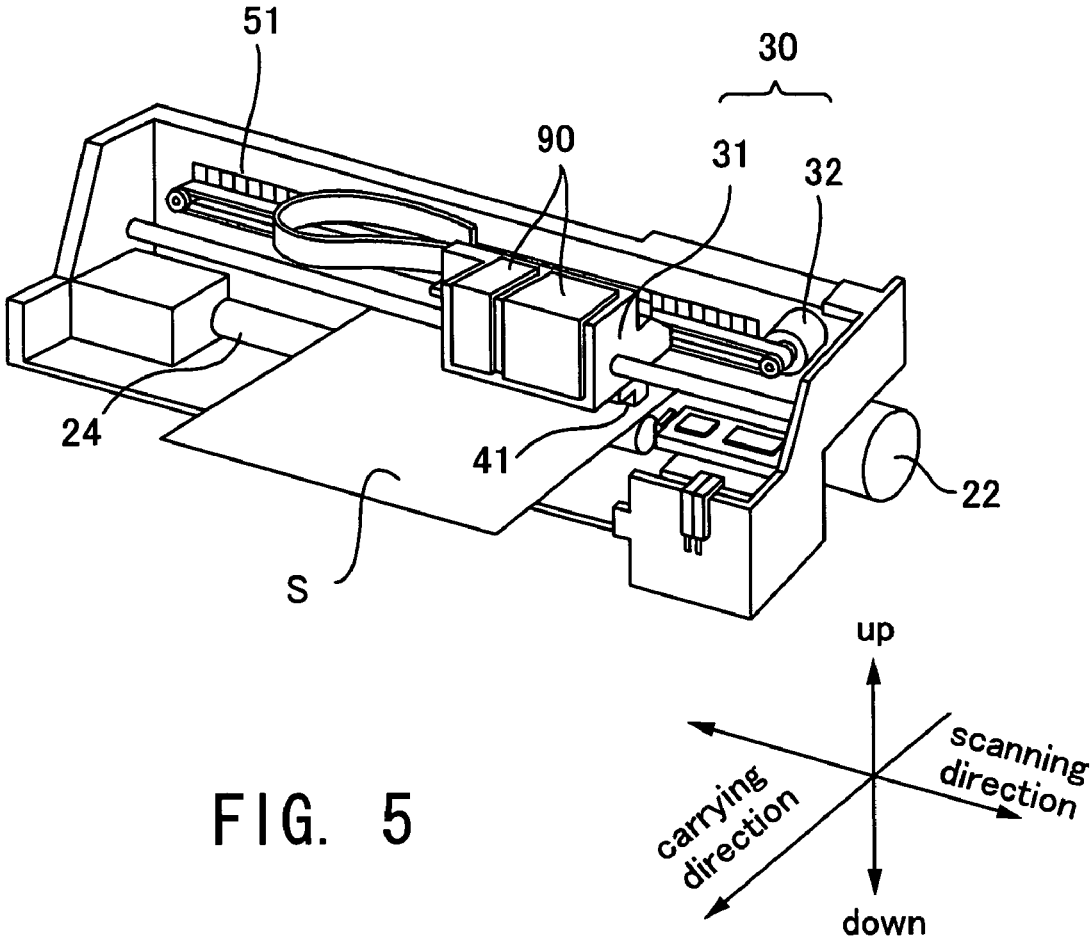
FIG. 5 is a schematic diagram of an overall configuration of the printer.
Figure 6:
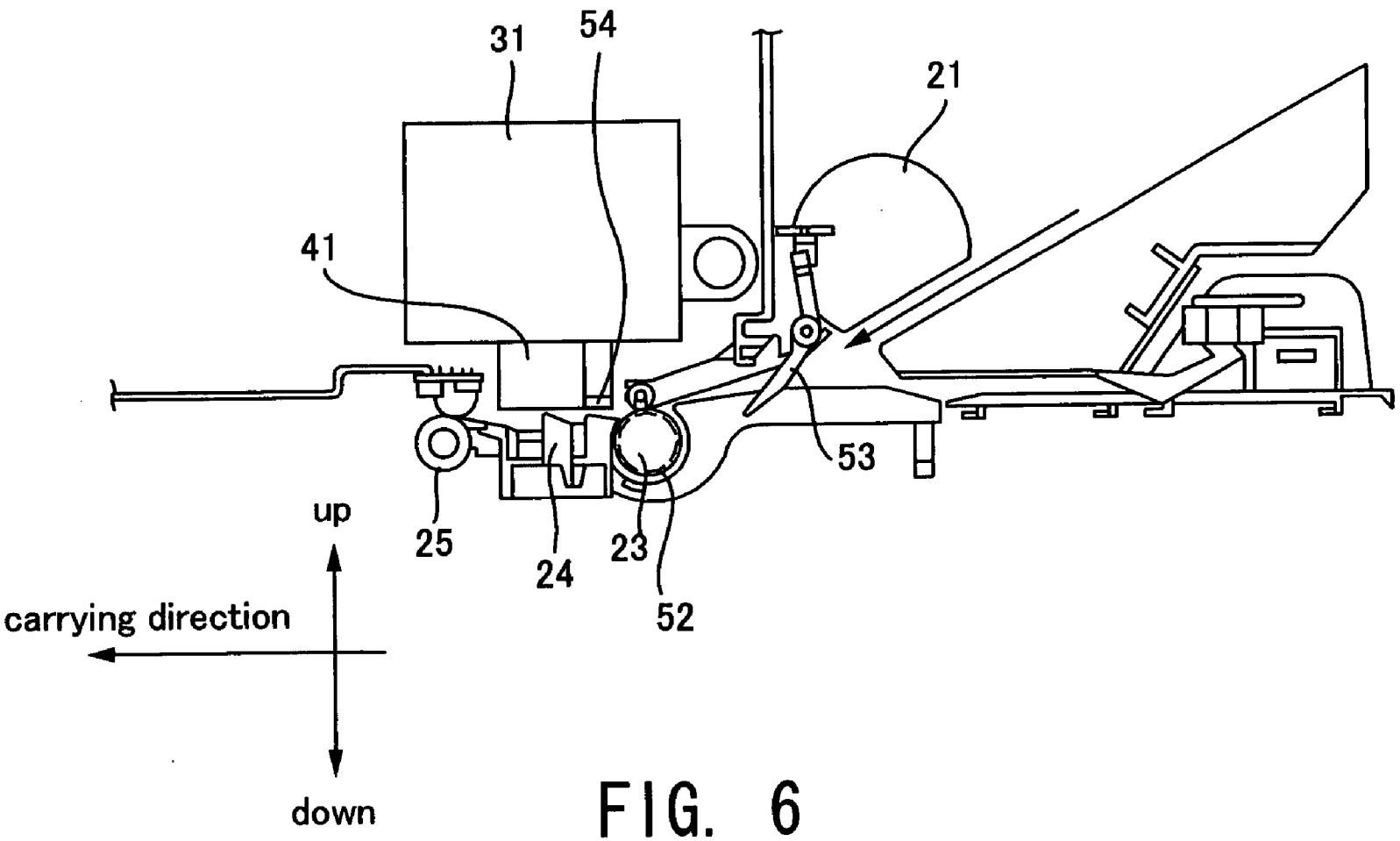
FIG. 6 is a transverse sectional view of an overall configuration of the printer.

FIG. 4 is a block diagram of an overall configuration of a printer according to the present embodiment. FIG. 5 is a schematic diagram of the overall configuration of the printer of this embodiment. FIG. 6 is a transverse sectional view of the overall configuration of the printer of this embodiment. The basic configuration of the printer according to the present embodiment is described below.

The printer of this embodiment has a carry unit 20, a carriage unit 30, a head unit 40, a detector group 50, and a controller 60. The printer 1 that has received print data from the computer 110, which is an external device, controls the various units (the carry unit 20, the carriage unit 30, and the head unit 40) with the controller 60. The controller 60 controls the units in accordance with the print data that are received from the computer 110 to form an image on a paper. The detector group 50 monitors the conditions within the printer 1, and it outputs the results of this detection to the controller 60. The controller 60 receives the detection results from the detector group 50, and controls the units based on these detection results.

The carry unit 20 is for feeding a medium (for example, paper S) to a printable position and carrying the paper in a predetermined direction (hereinafter, referred to as the "carrying direction") by a predetermined carry amount during printing. In other words, the carry unit 20 functions as a carrying mechanism (a carrying means) for carrying paper. The carry unit 20 has a paper supply roller 21, a carry motor 22 (hereinafter, referred to also as a "PF motor"), a carry roller 23, a platen 24, and a paper discharge roller 25. It should be noted that the carry unit 20 does not necessarily have to include all of these structural elements in order to function as a carrying mechanism. The paper supply roller 21 is a roller for automatically supplying, into the printer, paper that has been inserted into a paper insert opening. The paper supply roller 21 has a cross-sectional shape in the shape of the letter D, and the length of its circumferential portion is set longer than the carrying distance up to the carry roller 23, so that using this circumferential portion the paper can be carried up to the carry roller 23. The carry motor 22 is a motor for feeding paper in the paper carrying direction, and is constituted by a DC motor. The carry roller 23 is a roller for carrying the paper S that has been supplied by the paper supply roller 21 up to a printable region, and is driven by the carry motor 22. The platen 24 supports the paper S during printing. The paper discharge roller 25 is a roller for discharging the paper S, for which printing has finished, out of the printer. The paper discharge roller 25 is rotated in synchronization with the carry roller 23.

The carriage unit 30 is for making the head move (carry out scanning movement) in a predetermined direction (hereinafter, this is referred to as the "scanning direction"). The carriage unit 30 has a carriage 31 and a carriage motor (also referred to as a "CR motor") 32. The carriage 31 is capable of moving back and forth in the scanning direction (and thus, the head moves in the scanning direction). Also, the carriage 31 detachably holds ink cartridges 90 containing ink. The carriage motor 32 is a DC motor for moving the carriage 31 in the scanning direction.

The head unit 40 is for ejecting ink onto the paper. The head unit 40 has a head 41. The head 41 has a plurality of nozzles, which are ink ejection sections, and ejects ink intermittently from each of the nozzles. The head 41 is provided on the carriage 31. Thus, when the carriage 31 moves in the scanning direction, the head 41 also moves in the scanning direction. A dot line (raster line) is formed on the paper in the scanning direction as a result of the head 41 intermittently ejecting ink while moving in the scanning direction.

The detector group 50 includes, for example, a linear encoder 51, a rotary encoder 52, a paper detection sensor 53, and an optical sensor 54. The linear encoder 51 is for detecting the position of the carriage 31 in the scanning direction. The rotary encoder 52 is for detecting the amount of rotation of the carry roller 23. The paper detection sensor 53 is for detecting the position of the leading edge of the paper to be printed. The paper detection sensor 53 is provided in a position where it can detect the position of the leading edge of the paper as the paper is being fed toward the carry roller 23 by the paper supply roller 21. It should be noted that the paper detection sensor 53 is a mechanical sensor that detects the leading edge of the paper through a mechanical mechanism. More specifically, the paper detection sensor 53 has a lever that can be rotated in the carrying direction, and this lever is arranged such that it protrudes into the path over which the paper is carried. In this way, the leading edge of the paper comes into contact with the lever and the lever is rotated, and thus the paper detection sensor 53 detects the position of the leading edge of the paper by detecting movement of the lever. The optical sensor 54 is attached to the carriage 31. The optical sensor 54 detects whether or not the paper is present by irradiating light onto the paper from its light-emitting section and detecting the reflected light with its light-receiving section. The optical sensor 54 detects the positions of the edges of the paper while being moved by the carriage 41. The optical sensor 54 optically detects the edges of the paper, and thus has higher detection accuracy than the mechanical paper detection sensor 53.

The controller 60 is a control unit (controlling means) for carrying out control of the printer. The controller 60 has an interface section 61, a CPU 62, a memory 63, and a unit control circuit 64. The interface section 61 exchanges data between the computer 110, which is an external device, and the printer 1. The CPU 62 is an arithmetic processing unit for carrying out overall control of the printer. The memory 63 is for reserving, for example, a working region and a region for storing the programs for the CPU 62, and includes memory means such as a RAM or an EEPROM. The CPU 62 controls the various units via the unit control circuit 64 in accordance with programs stored in the memory 63.

<Regarding the Printing Operation>

Figure 7:
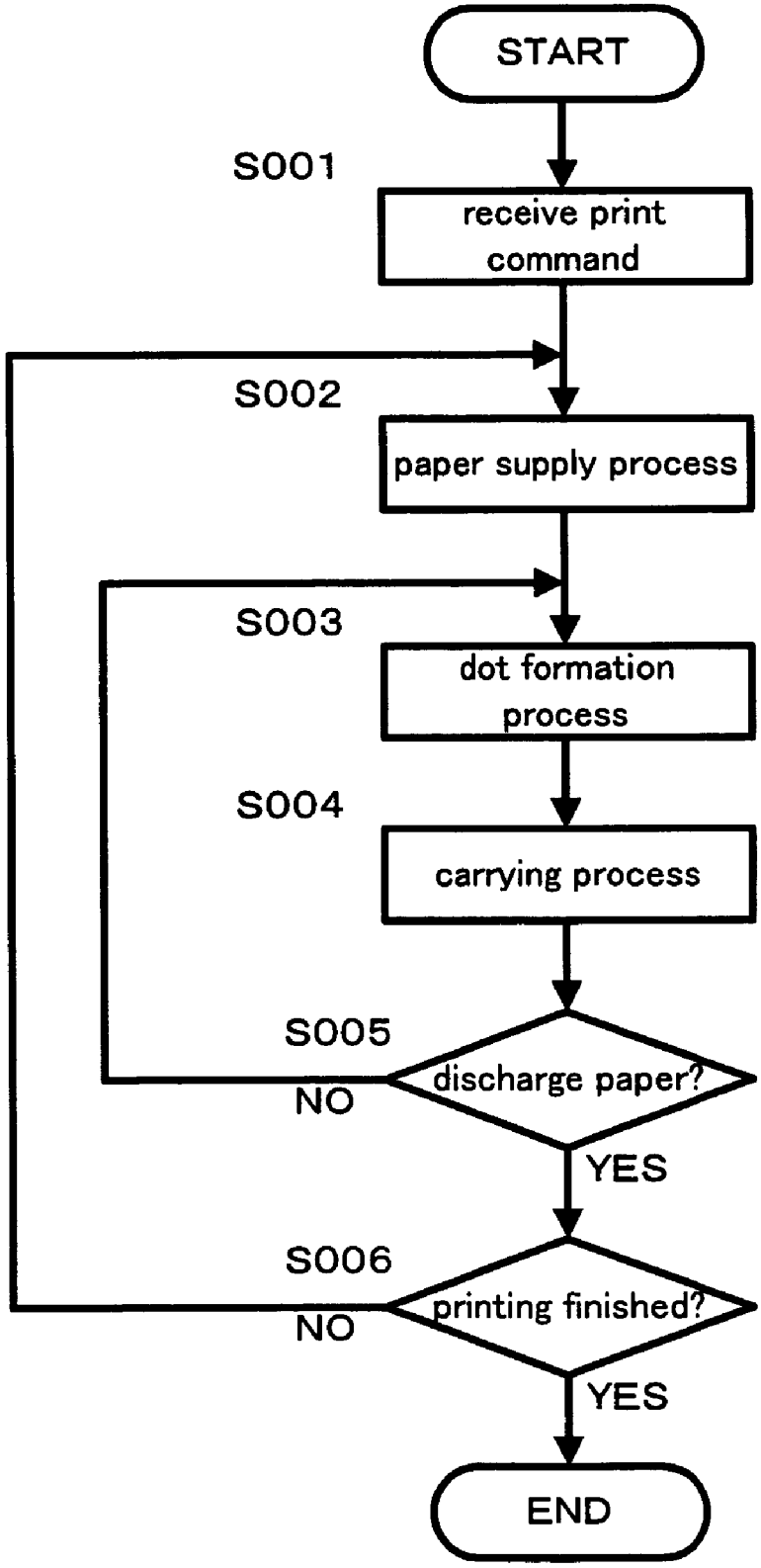
FIG. 7 is a flowchart of the processing during printing.

FIG. 7 is a flowchart of the processing during printing. The processes described below are executed by the controller 60 controlling the various units in accordance with a program stored in the memory 63. This program includes codes for executing the various processes.

The controller 60 receives a print command via the interface section 61 from the computer 110 (S001). This print command is included in the header of the print data transmitted from the computer 110. The controller 60 then analyzes the content of the various commands included in the print data that has been received and uses the units to perform the following paper supply process, carrying process, and ink ejection process, for example.

First, the controller 60 performs the paper supply process (S002). The paper supply process is a process for supplying paper to be printed into the printer and positioning the paper at a print start position (also referred to as the "indexing position"). The controller 60 rotates the paper supply roller 21 to feed the paper to be printed up to the carry roller 23. The controller 60 then rotates the carry roller 23 to position the paper that has been fed from the paper supply roller 21 at the print start position. When the paper has been positioned at the print start position, at least some of the nozzles of the head 41 are in opposition to the paper.

Next, the controller 60 performs the dot formation process (S003). The dot formation process is a process of intermittently ejecting ink from the head, which moves in the scanning direction, so as to form dots on the paper. The controller 60 drives the carriage motor 32 to move the carriage 31 in the scanning direction. The controller 60 then causes the head to eject ink in accordance with the print data during the period that the carriage 31 is moving. Dots are formed on the paper when ink droplets ejected from the head land on the paper.

Next, the controller 60 performs the carrying process (S004). The carrying process is a process for moving the paper in the carrying direction relative to the head. The controller 60 drives the carry motor to rotate the carry roller and thereby carry the paper in the carrying direction. Through this carrying process, the head 41 can form dots at positions that are different from the positions of the dots formed in the preceding dot formation process.

Next, the controller 60 determines whether or not to discharge the paper being printed (S005). The paper is not discharged if there still is data for printing on the paper, which is being printed. In this case, the controller 60 alternately repeats the dot formation and carrying processes until there is no more data for printing, thereby gradually printing, on the paper, an image made of dots. When there is no more data for printing the paper being printed, the controller 60 discharges that paper. The controller 60 discharges the printed paper to the outside by rotating the paper discharge roller. It should be noted that whether or not to discharge the paper may also be determined based on a paper discharge command included in the print data.

Next, the controller 60 determines whether or not to continue printing (S006). If the next sheet of paper is to be printed, then printing is continued and the paper supply process for the next sheet of paper is started. If the next sheet of paper is not to be printed, then the printing operation is ended.

<Regarding the Nozzles>

Figure 8:
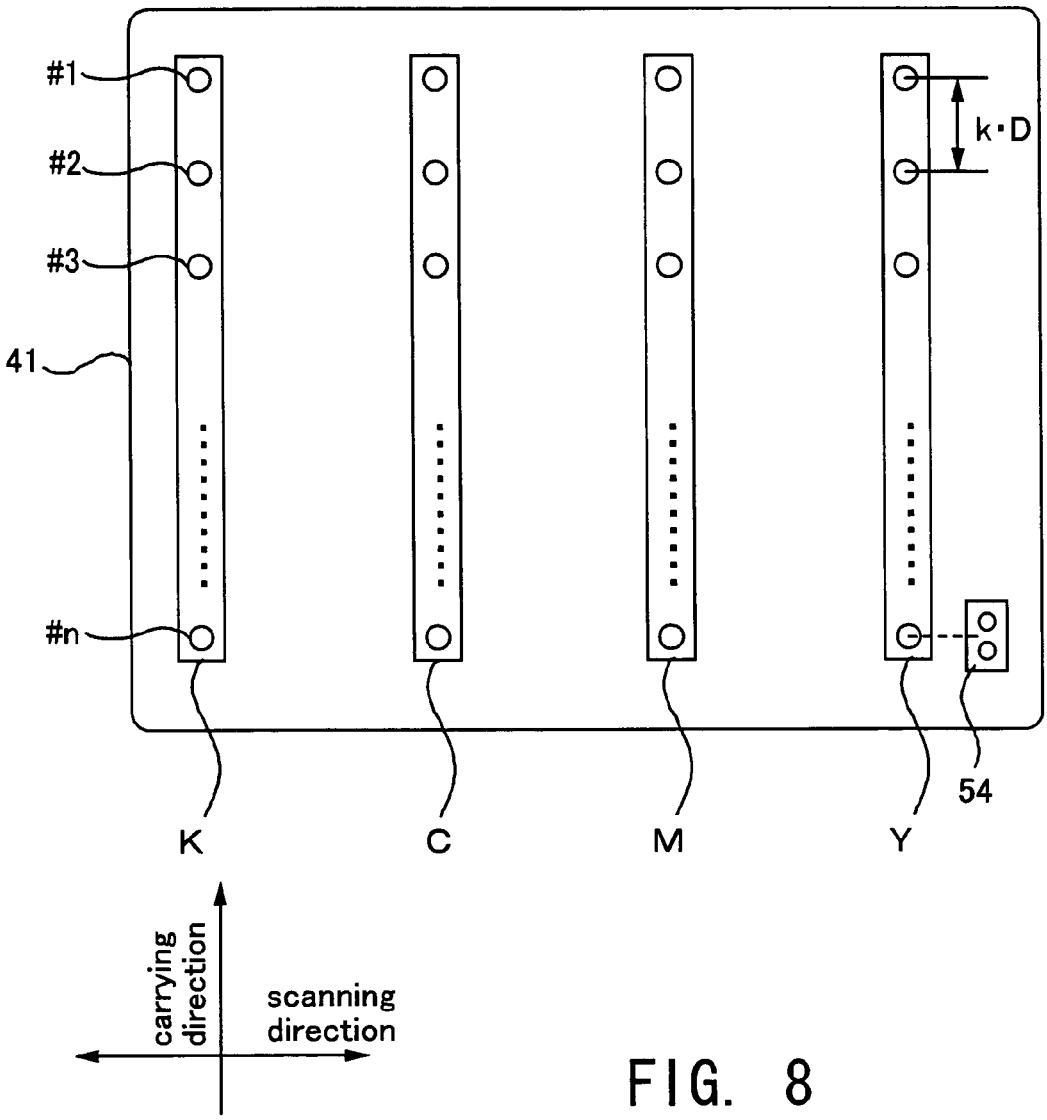
FIG. 8 is an explanatory diagram showing the arrangement of nozzles.

FIG. 8 is an explanatory diagram showing the arrangement of nozzles in the lower surface of the head 41. A black ink nozzle group K, a cyan ink nozzle group C, a magenta ink nozzle group M, and a yellow ink nozzle group Y are formed in the lower surface of the head 41. Each nozzle group is provided with a plurality of nozzles (in this embodiment, 180 nozzles), which are ejection openings for ejecting ink of the respective colors.

The plurality of nozzles of the nozzle groups are arranged in a row at a constant spacing (nozzle pitch: k·D) in the carrying direction. Here, D is the minimum dot pitch in the carrying direction (that is, the interval between dots, which are formed on the paper S, at the maximum resolution). Furthermore, k is an integer that is 1 or greater. For example, if the nozzle pitch is 180 dpi (1/180 inch), and the dot pitch in the carrying direction is 720 dpi (1/720), then k=4.

The nozzles in each nozzle group are assigned a number (#1 to #180) that becomes smaller the more downstream the nozzle is positioned. That is, the nozzle #1 is positioned more downstream in the carrying direction than the nozzle #180. Each nozzle is provided with a piezo element (not shown) as a drive element for driving the nozzle and causing it to eject an ink droplet. Also, the optical sensor 54 is provided substantially in the same position as the nozzle #180, which is on the most upstream side, as regards its position in the paper carrying direction.

Printing Schemes

<(1) Regarding the Regular Printing Scheme (Interlace Printing Scheme)>

First, the regular printing scheme (interlace printing scheme) is described. Here, "interlace printing scheme" refers to a printing scheme in which, in one pass, raster lines that are not recorded are sandwiched between raster lines that are recorded. Furthermore, "pass" refers to one scanning movement of the nozzles in the scanning direction. "Raster line" refers to a row of pixels lined up in the scanning direction and is also referred to as "scanning line." Furthermore, "pixels" are the square grids that are determined in a virtual manner on the medium to be printed in order to define the positions where ink droplets are made to land so as to record dots.

Figure 9A:
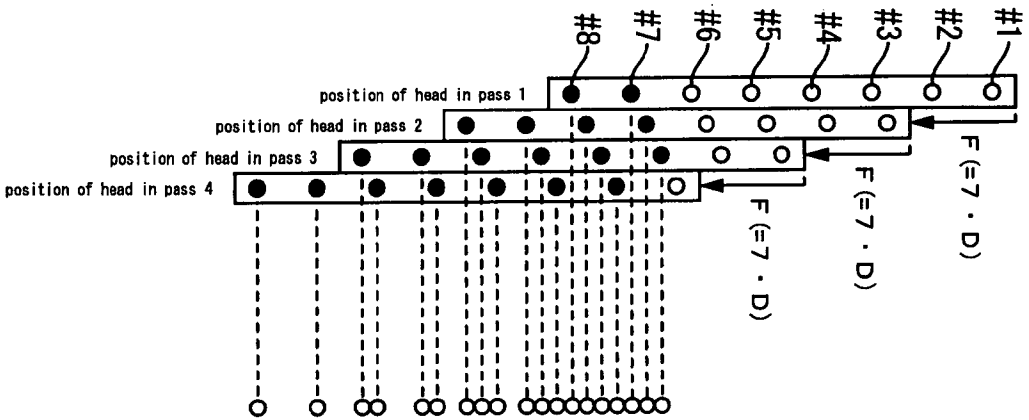
FIGS. 9A and 9B are explanatory diagrams of regular interlace printing.
Figure 9B:
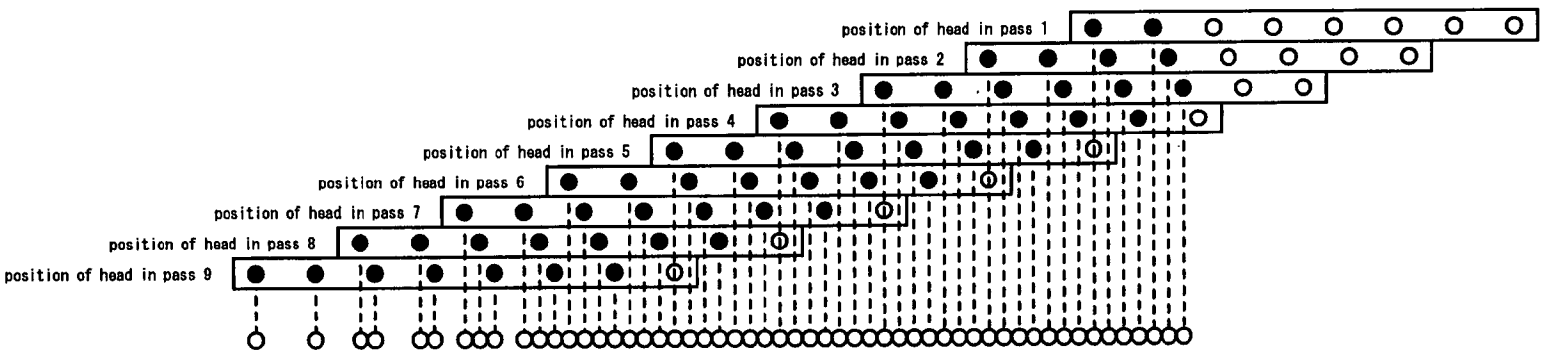

FIGS. 9A and 9B are explanatory diagrams of regular interlace printing. It should be noted that, for convenience's sake, the head (and the nozzles) is illustrated in the figures as if it is moving in the carrying direction with respect to the paper, but the figures merely show the relative positional relationship between the head and the paper, and in reality, it is the paper that is being moved in the carrying direction. Furthermore, in practice, there are 180 nozzles lined up in the carrying direction, but in this example, there are only eight nozzles to simplify description. Furthermore, a head has a plurality of nozzle groups, but in this example, the head is described as having only one nozzle group to simply description.

In FIGS. 9A and 9B, a nozzle represented by a black circle is a nozzle that can eject ink. A nozzle represented by a white circle is a nozzle that does not eject ink. FIG. 9A shows the positions of the head and the state of the dot formation in passes 1 to 4. FIG. 9B shows the positions of the head and the state of the dot formation in passes 1 to 9.

With interlace printing, every time the paper is carried in the carrying direction by a constant carry amount F, the nozzles record a raster line immediately above the raster line that was recorded in the immediately prior pass. In order to carry out recording in this way with a constant carry amount, the number N (integer) of nozzles that can eject ink is coprime to k and the carry amount F is set to N·D.

In FIGS. 9A and 9B, the head has eight nozzles arranged in the carrying direction. However, since the nozzle pitch k is 4, in order to fulfill the condition for performing interlace printing, which is that "N and k are coprimes," not all the nozzles can be used. Therefore, seven of the eight nozzles are used to perform interlace printing. Furthermore, because seven nozzles are used, the paper is carried using a carry amount of 7·D. As a result, using a nozzle group with a nozzle pitch of 180 dpi (4·D) for example, dots are formed on the paper with a dot interval of 720 dpi (=D).

FIGS. 9A and 9B show how continuous raster lines are formed continuously, with the first raster line being formed by nozzle #3 in pass 3, the second raster line being formed by nozzle #5 in pass 2, the third raster line being formed by nozzle #7 in pass 1, and the fourth raster line being formed by nozzle #2 in pass 4. It should be noted that in and after pass 3, all seven nozzles (#2 to #8) eject ink and the paper is carried by a constant carry amount F (=7·D) to form continuous raster lines with a dot interval D.

<(2) Regarding the Regular Printing Scheme (Interlace Printing Scheme)>

There were eight nozzles in the description above in order to simplify description. However, in practice there are 180 nozzles. The following is a description of interlace printing in the case of 180 nozzles.

Figure 10A:
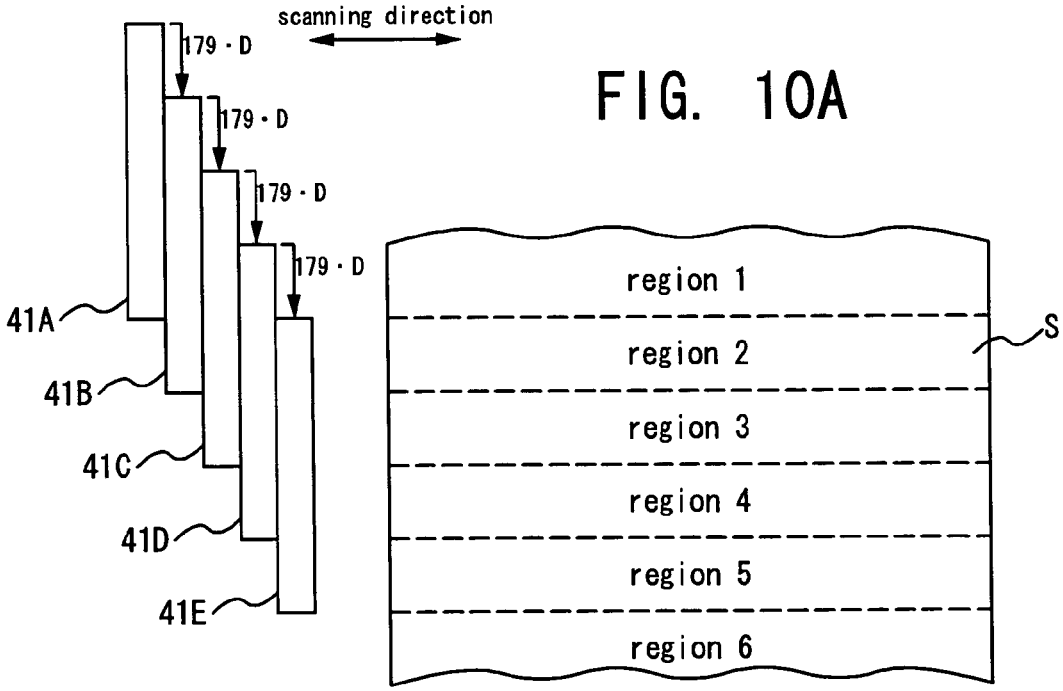
FIG. 10A is an explanatory diagram of actual interlace printing.

FIG. 10A is an explanatory diagram of actual interlace printing. FIG. 10A shows the relative positional relationship between the head and paper. Here, the head has 180 nozzles arranged in the carrying direction. However, since the nozzle pitch k is 4, in order to fulfill the condition for performing interlace printing, which is that "N and k are coprimes," not all the nozzles can be used. Therefore, 179 of the 180 nozzles are used to perform interlace printing. Furthermore, because 179 nozzles are used, the paper is carried using a carry amount of 179·D.

In a given pass, the head 41A ejects ink while moving in the scanning direction to form dots (raster lines) in region 1 of the paper. Next, the paper is carried by 179·D (=179/720 inch) and the head moves relatively with respect to the paper to the position of the head 41B shown in the drawing. In the next pass, the head 41B ejects ink while moving in the scanning direction to form dots (raster lines) in region 1 and region 2 of the paper. The operation continues in this way until the head 41E forms dots on the paper.

Figure 10B:
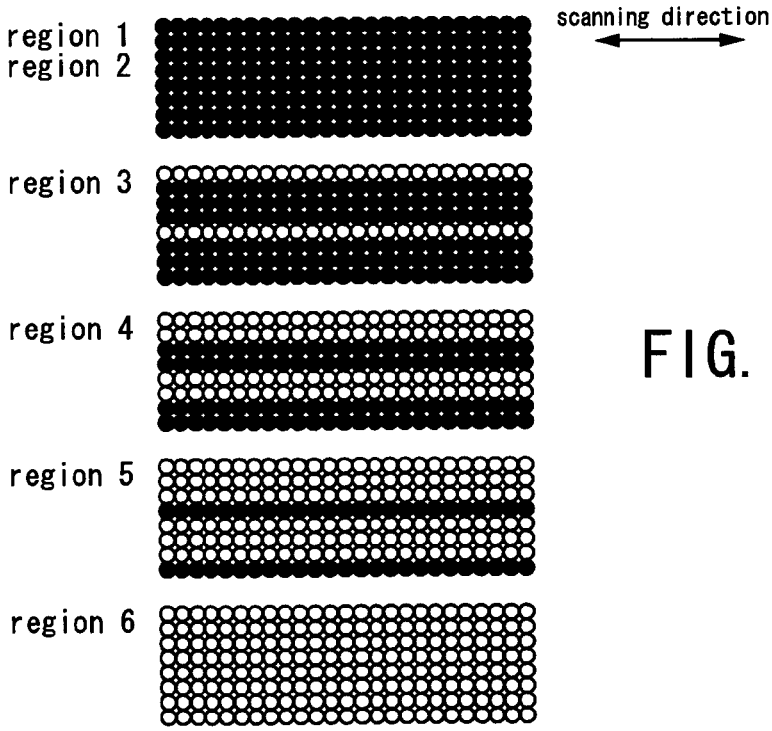
FIG. 10B is an explanatory diagram of dot formation conditions in different regions.

FIG. 10B is an explanatory diagram of dot formation conditions in the regions after the head 41E has formed dots on the paper. In FIG. 10B, white circles represent pixels in which no dot has been formed. Furthermore, black circles represent pixels in which a dot has been formed.

In region 1, dots (raster lines) are formed in four passes with the head 41A to 41D. Furthermore, in region 2, dots are formed in four passes using the head 41B to 41E. In this way, in regions where four passes have been made, dots are formed in all the pixels in those regions. In region 3, dots are formed by three passes with the head 41C to 41E. In this way, in regions where three passes have been made, dots are formed in the pixels of three of the four raster lines. In region 4, dots are formed in two passes with the head 41D and 41E. In this way, in regions where two passes have been made, dots are formed in the pixels of two of the four raster lines. In region 5, dots are formed in one pass with the head 41E. In this way, in regions where one pass has been made, dots are formed in the pixels of one of the four raster lines. It should be noted that region 6 is in a state in which dots are not yet formed.

In this way, with interlace printing, dots are not formed in all the pixels of the region facing the head in only a single scan of that head (i.e., with only one pass). Specifically, in order to form dots in all the pixels of a given region, it is necessary to make k passes. When dots are formed in all the pixels of a given region, that region would be carried up to a position in opposition to a portion at approximately one-quarter of the head 41 on the downstream side in the carrying direction.

<(1) Regarding Deterioration of Print Image>

Figure 11:
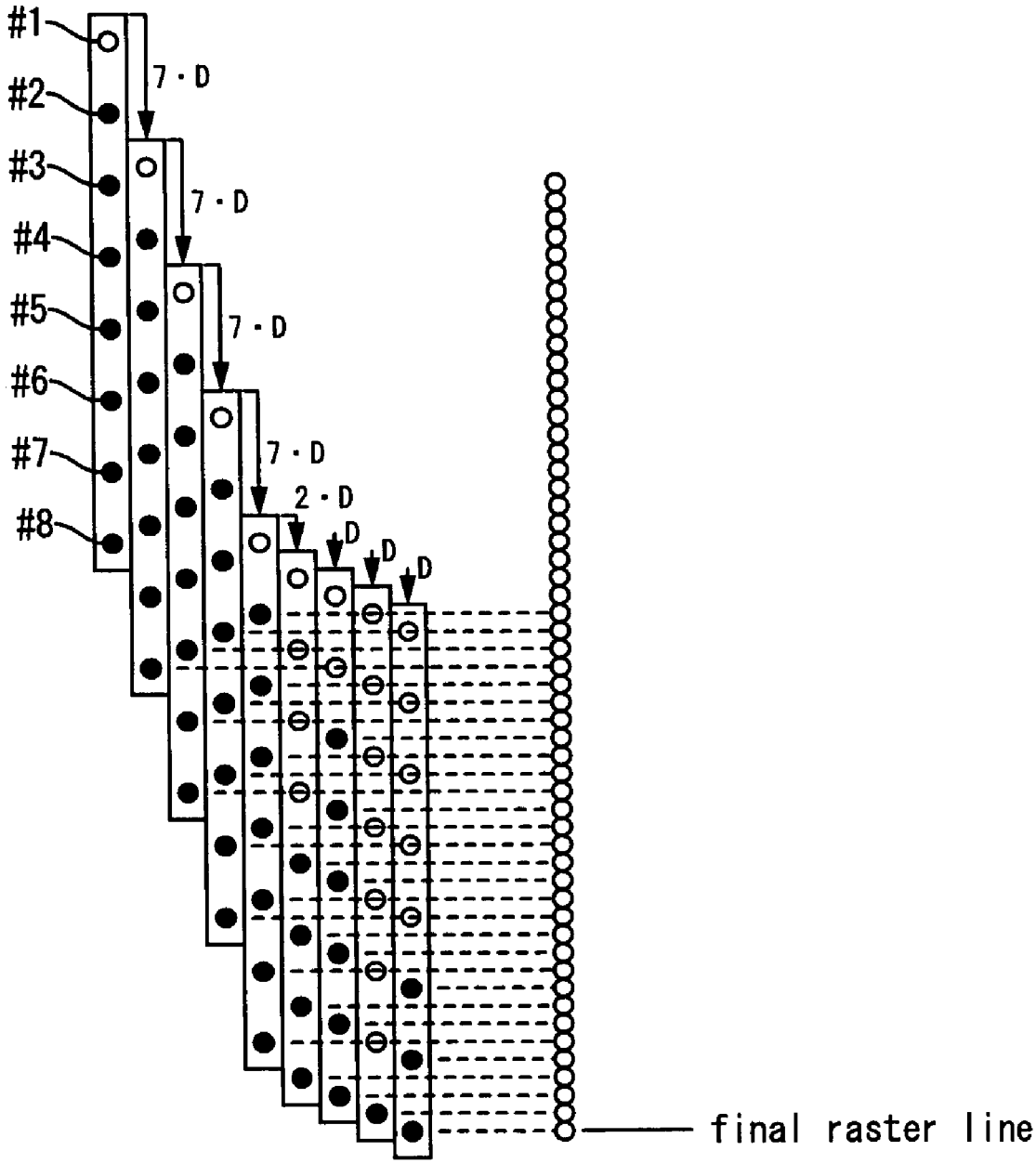
FIG. 11 is an explanatory diagram of a state when a rear edge printing process has been performed.

FIG. 11 is an explanatory diagram showing how the printing process is performed in the vicinity of the rear edge of a print image in which the carry amount is reduced (hereinafter referred to as "rear edge printing process"). It should be noted that, in practice, there are 180 nozzles lined up in the carrying direction, but in the present example, there are only eight nozzles to simplify description.

As already described, when using seven nozzles in interlace printing, the paper is carried by a carry amount 7·D. However, with the rear edge printing process, in the vicinity of the rear edge of the image to be printed (or "print image"), the paper S is carried by a carry amount smaller than the carry amount during interlace printing. Specifically, when printing in the vicinity of the rear edge of the print image, the carry unit carries the paper by a carry amount 2·D such that the most downstream nozzle is arranged in opposition to the fourth raster line from the final raster line, after which the paper is carried by the carry amount D. In this way, in the rear edge printing process, the final raster line (the most upstream raster line of the image on the paper in the carrying direction) is formed by the most upstream nozzle in the carrying direction.

If the carry unit carries the paper by an ideal carry amount in interlace printing and the rear edge printing process, there is no deterioration in the image formed on the paper. However, the actual carry amount of the carry unit varies from the ideal carry amount due to the influence of such factors as slippage between the carry roller and the paper. The amount of displacement between the ideal carry amount and the actual carry amount varies if the carry amounts vary. Accordingly, when the carry amount changes during printing, the amount of displacement changes. This may cause bands that extend in the scanning direction between the image printed before the change in the carry amount and the image printed after the change in the carry amount, thus causing the image to deteriorate.

Accordingly, in order to carry out high-quality printing, it is better that the carry amount is not changed during printing.

<(2) Regarding Deterioration of Print Image>

Figure 12A:
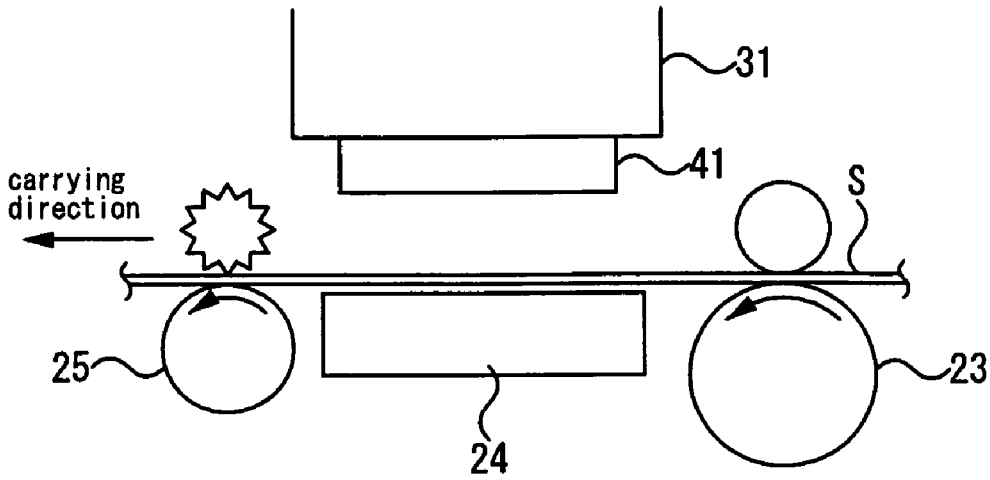
FIG. 12A is an explanatory diagram of a state during regular carrying.
Figure 12B:
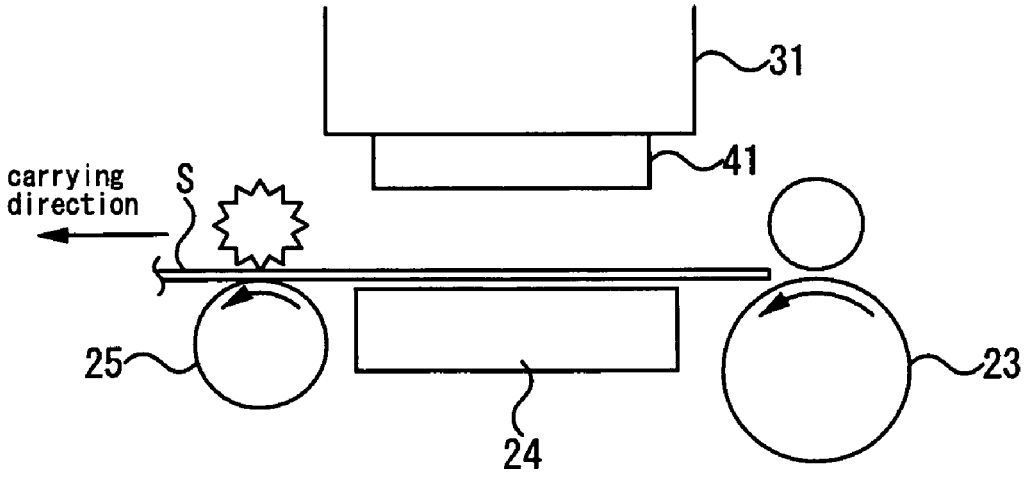
FIG. 12B is an explanatory diagram of a state during carrying after the rear edge of the paper has passed the carry roller.

FIG. 12A is an explanatory diagram of a state during regular carrying. FIG. 12B is an explanatory diagram of a state during carrying after the rear edge of the paper has passed the carry roller. Structural elements in these figures that have already been described are assigned identical reference numerals and thus further description thereof is omitted.

The carry roller 23 (upstream roller) positioned on the upstream side of the print region in the carrying direction and the paper discharge roller 25 (downstream roller) positioned on the downstream side of the print region in the carrying direction are rotated in synchronization with one another. Also, during regular carrying, the paper S is carried by these two rollers, namely the carry roller 23 and the paper discharge roller 25.

However, the carrying states before and after the rear edge of the paper S passes the carry roller 23 are different. For example, after the rear edge of the paper S has passed the carry roller 23, the paper S is carried only by the paper discharge roller 25, and therefore, this state differs from the state when the paper is carried by both rollers (i.e., the state of regular carrying). Also, the shape (for example, the radius and the cross-sectional shape) of the carry roller 23 and the paper discharge roller 25 is different. Further, the roller provided in opposition to the paper discharge roller 25 has a different shape from the driven roller on the carry roller 23 side in order to reduce contact with the print surface. Also, to prevent creases from forming in the paper during regular carrying, the carrying velocity of the paper discharge roller 25 is designed to be slightly faster than the carrying velocity of the carry roller 23. Because of these factors, the carrying state after the rear edge of the paper S has passed the carry roller 23 is different from the regular carrying state. Furthermore, since the area of contact between the paper discharge roller and the paper is small, stable carrying cannot be performed in a carrying operation using only the paper discharge roller.

As a result, dots formed after the rear edge of the paper S has passed the carry roller 23 are displaced in the carrying direction with respect to dots formed before the rear edge of the paper S has passed the carry roller 23. This causes bands that extend in the scanning direction between the image printed before the rear edge of the paper S has passed the carry roller 23 and the image printed after the rear edge of the paper S has passed the carry roller 23, thus causing the image to deteriorate.

Accordingly, in order to carry out high-quality printing, it is preferable that printing is completed before the rear edge of the paper S passes the carry roller 23.

In a printing method according to the present embodiment described below, an image is printed on paper such that the factors of image deterioration are eliminated as much as possible.

Selection of Printing Scheme

<Flow of the Method for Selecting a Printing Scheme>

Figure 13:
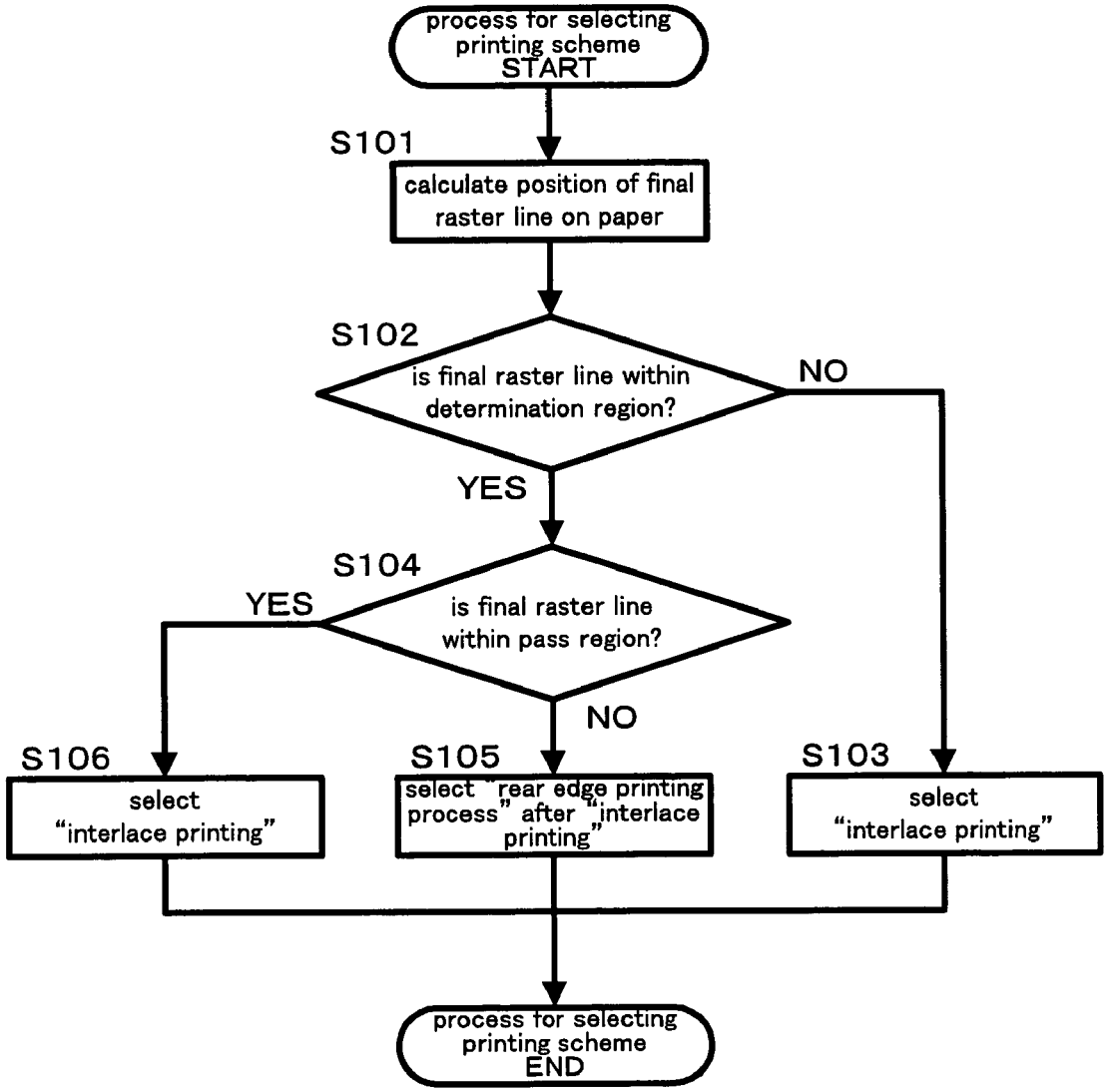
FIG. 13 is a flowchart of a method for selecting a printing scheme in the present embodiment.
Figure 14A:
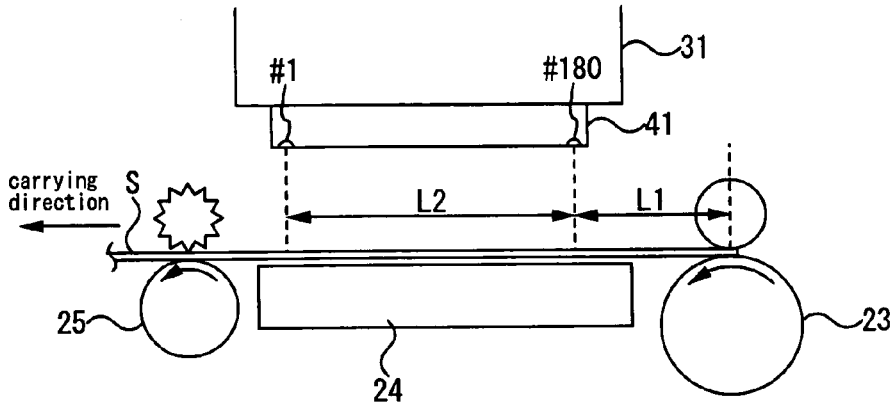
FIG. 14A is an explanatory diagram of the positional relationship between the carry roller and the nozzles.
Figure 14B:
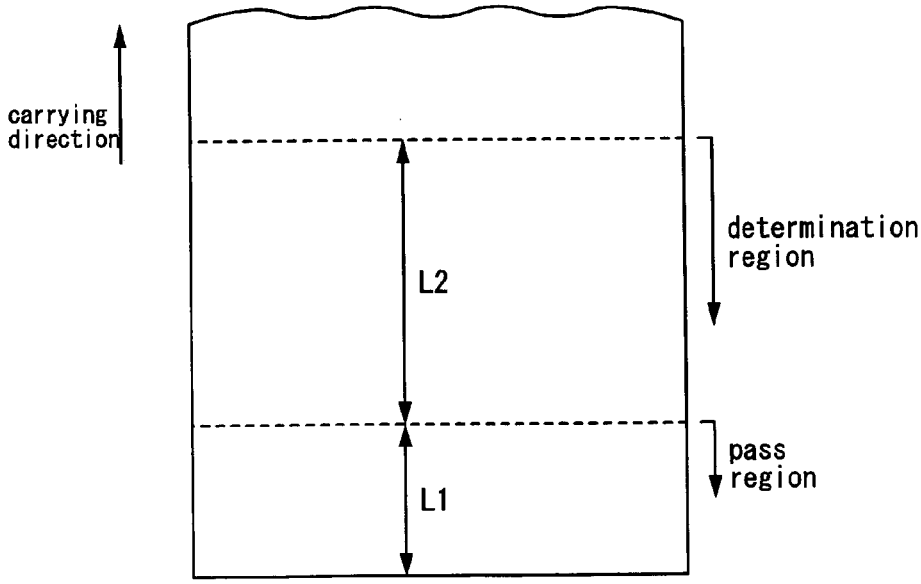
FIG. 14B is an explanatory diagram of a determination region and a pass region on the paper.

FIG. 13 is a flowchart of a method for selecting a printing scheme according to the present embodiment. FIG. 14A is an explanatory diagram showing the positional relationship between the carry roller and the nozzles. FIG. 14B is an explanatory diagram showing the determination region and the pass region on the paper.

First, the determination region and the pass region are described. As shown in FIG. 14B, "determination region" refers to the region L1+L2 and below up to the rear edge of the paper. On the other hand, as shown in FIG. 14B, "pass region" refers to the region L1 and below up to the rear edge of the paper. As shown in FIG. 14A, L1 refers to the distance from the position in which paper is sandwiched between the carry roller 23 and the driven roller up to the position in opposition to the nozzle #180 (or, the position at which ink ejected from the nozzle #180 lands). On the other hand, as shown in FIG. 14A, L2 refers to the distance between the nozzle #1 and the nozzle #180. As evident from this positional relationship, when the nozzle #180 is brought in opposition to the pass region, the rear edge of the paper passes the carry roller. Also, when the nozzle #1 is brought in opposition to the determination region, the rear edge of the paper passes the carry roller.

Selection of the printing scheme according to the present embodiment is carried out when the printer driver performs rasterization after the printer driver has performed halftone processing. Since the order of pixel data that are required to be sent to the printer is determined in accordance with the printing scheme, the printer driver creates carry commands and pixel data that are included in the print data according to the selected printing scheme and outputs the print data to the printer. It should be noted that the printer causes the carry unit to carry paper by a predetermined carry amount in accordance with the carry commands from the computer. Furthermore, the printer causes ink to be ejected from the nozzles in accordance with pixel data from the computer.

The printer driver executes the process described below making use of hardware resources such as the CPU and memory of the computer. That is, the printer driver is provided with a program for causing the computer to execute the process described below.

Figure 15:
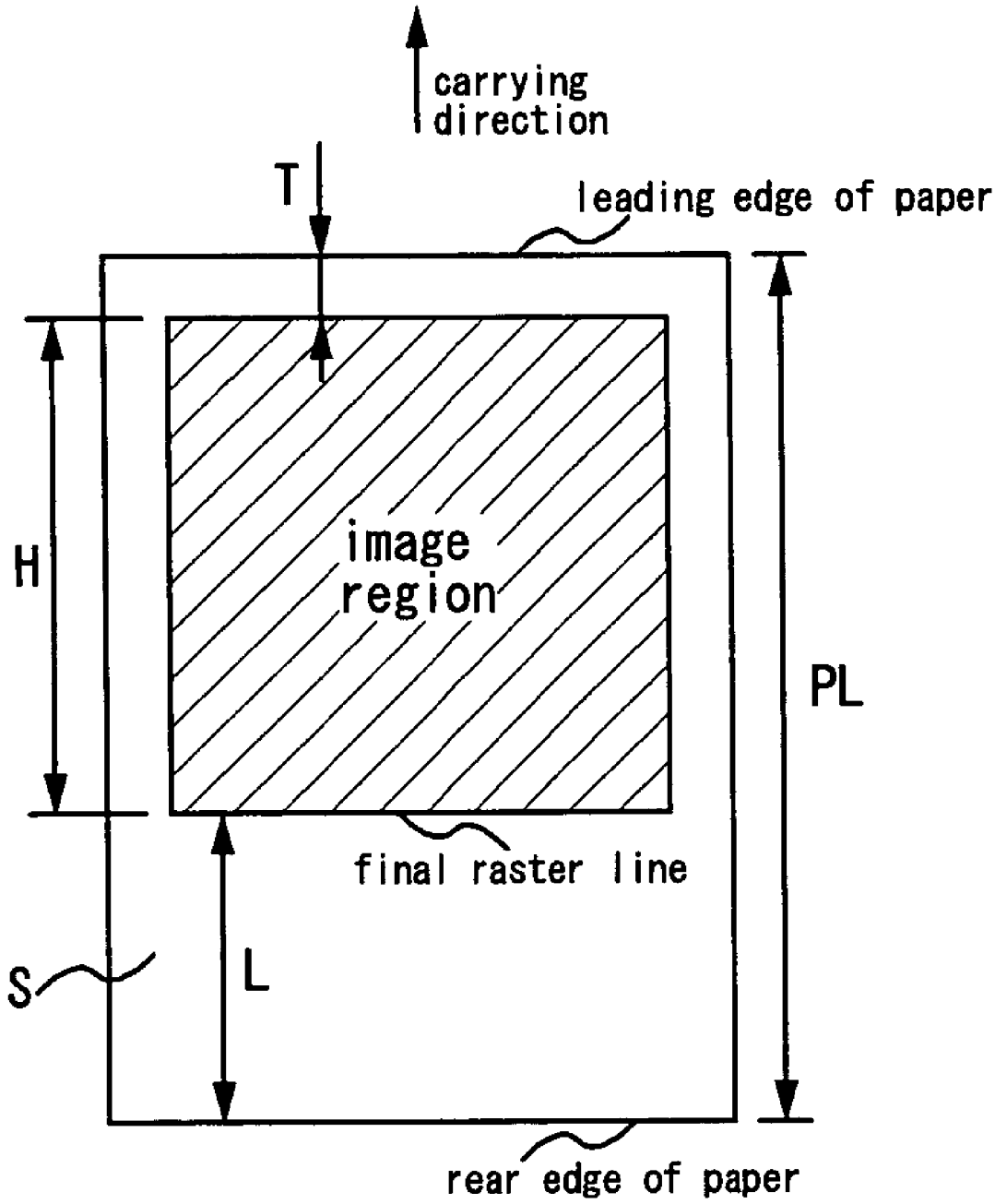
FIG. 15 is an explanatory diagram of a position of the final raster line on the paper.

First, the printer driver calculates the position of the final raster line on the paper (S101). Here, the printer driver calculates the position of the final raster line on the paper according to information about the paper size and information about the size of pixel data that have undergone halftone processing. For example, as shown in FIG. 15, a position L of the final raster line on the paper can be calculated according to information PL of the length of the paper in the carrying direction, information H of the length of the image in the carrying direction, and information T of the margin at the leading edge. It should be noted that, since the size of the paper is input by the user during the setting of the printer driver, information about the size of the paper can be determined according to the result of this input. For example, when A4 size paper is selected, the length of the paper in the carrying direction is 297 mm.

Next, the printer driver determines whether or not the final raster line is positioned in the determination region (S102). This determination is carried out according to the calculated position of the final raster line on the paper. Specifically, the printer driver compares the calculated position L (FIG. 15) of the final raster line on the paper with L1+L2 (FIG. 14B).

If the final raster line is not in the determination region ("NO" at S102), then interlace printing is selected (S103) until the completion of printing. That is, even when printing the rear edge of the image, interlace printing is performed throughout the whole process, without the rear edge printing process being performed, and the entire image on the paper is printed using interlace printing.

On the other hand, if the final raster line is in the determination region, the printer driver then determines whether or not the final raster line is positioned in the pass region (S104). This determination is carried out according to the calculated position of the final raster line on the paper. Specifically, the printer driver compares the calculated position L (FIG. 15) of the final raster line on the paper with L1 (FIG. 14B).

If the final raster line is not in the pass region ("NO" at S104), then the rear edge printing process is performed after the interlace printing. In this way, the above-mentioned rear edge printing process is performed when forming the rear edge of the image on the paper, after interlace printing.

If the final raster line is in the pass region ("YES" at S104), interlace printing is selected. That is, even when printing the rear edge of the image, interlace printing is performed throughout the whole process, without the rear edge printing process being performed, and the entire image on the paper is printed using interlace printing.

<Effect 1 of the Present Embodiment>

Figure 16A:
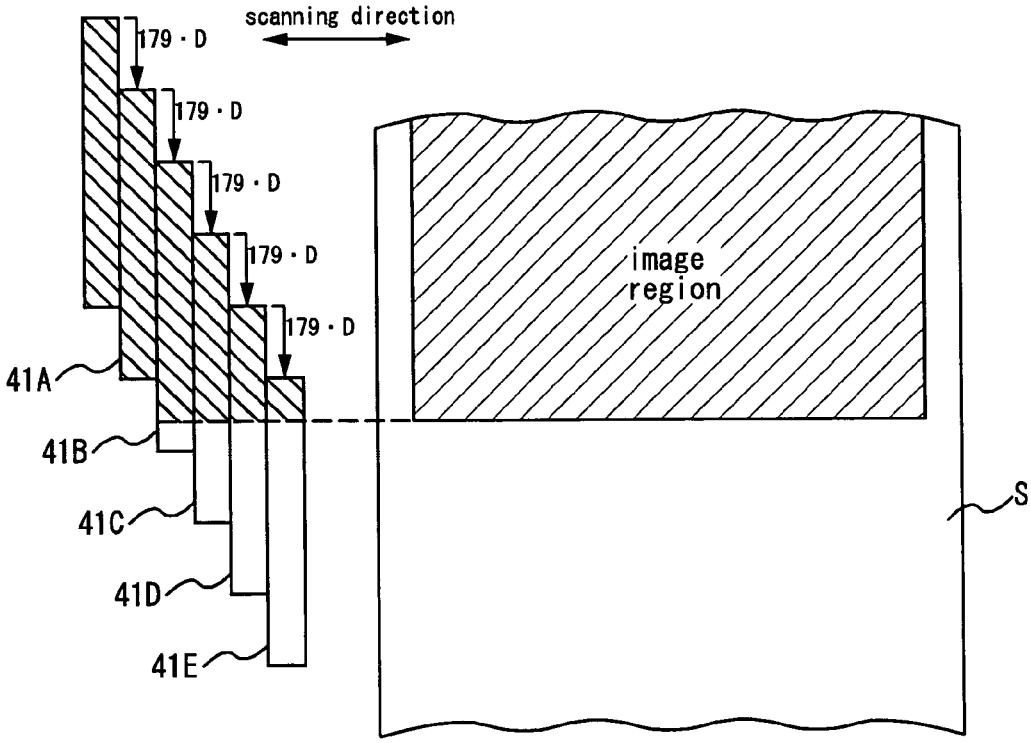
FIG. 16A is an explanatory diagram of a state of printing when interlace printing is selected in step S103.

FIG. 16A is an explanatory diagram of the state of printing when interlace printing is selected in the above-mentioned step S103. The hatched portion on paper S in this figure indicates the image region formed on the paper. Furthermore, the hatched portions of the head in this figure indicate that ink is ejected from the nozzles positioned in the hatched portions. In this case, the paper is carried by a constant carry amount (179·D) and the image is printed on the paper. When printing is finished, the final raster line is in opposition to a portion at approximately one-quarter of the head 41E on the downstream side in the carrying direction. In other words, when printing is finished, the nozzle #1 is positioned further on the downstream side than the determination region.

That is, in this case, the image is formed on the paper in a state in which the rear edge of the paper has not passed the carry roller 23. Furthermore, there is no change in the carry amount of the paper, and printing is carried out with a constant carry amount. Accordingly, high-quality printing is possible.

Figure 16B:
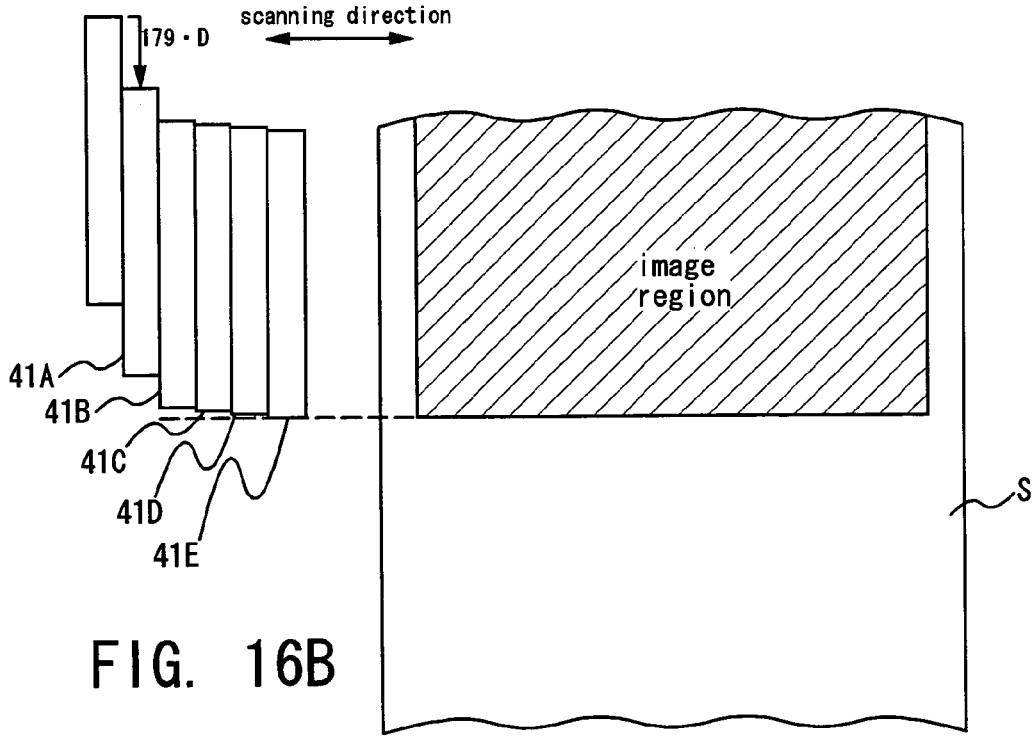
FIG. 16B is for describing a comparative example.

FIG. 16B is an explanatory diagram of a comparative example. This example describes a case in which, as shown in FIG. 16B, the rear edge printing process is performed to print the rear edge of the image. Also in this case, as in the case of FIG. 16A, the image is formed on the paper in a state in which the rear edge of the paper has not pass the carry roller 23. However, the carry amount has been changed during printing; therefore, displacement occurs between the raster line formed on the paper by the head 41A and the raster lines formed on the paper by the head 41B to 41E, thus causing bands that extend in the scanning direction and causing the image to deteriorate.

Accordingly, the image printed as in FIG. 16A has higher quality than the image printed as in FIG. 16B.

<Effect 2 of the Present Embodiment>

Figure 17A:
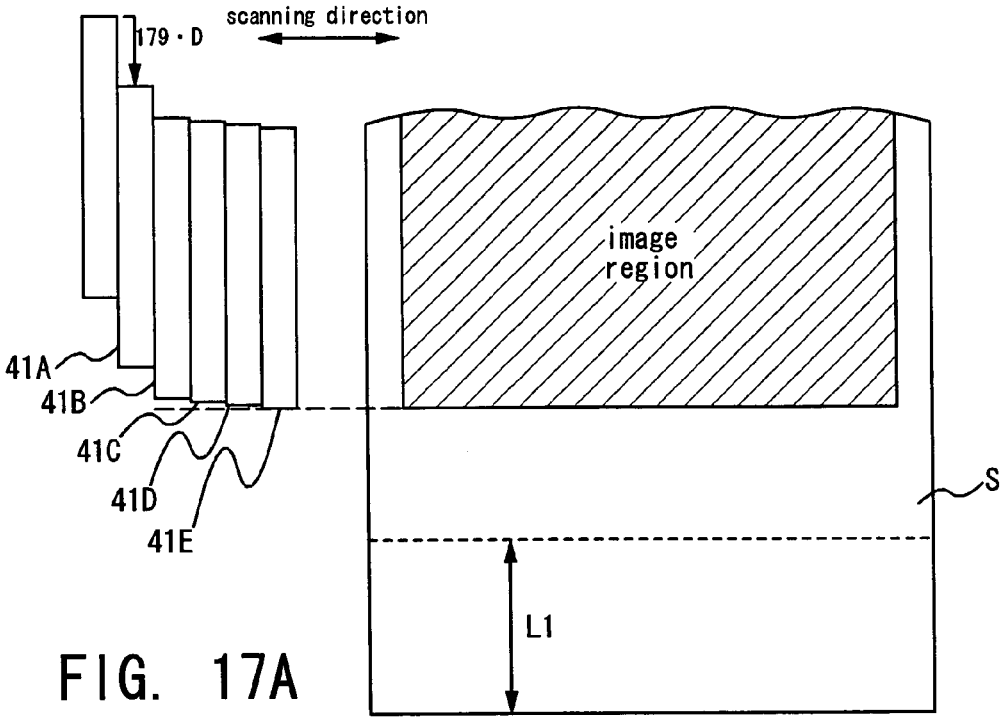
FIG. 17A is an explanatory diagram of a state of printing when the rear edge printing process has been performed after interlace printing according to step S105.

FIG. 17A is an explanatory diagram showing the state of printing in the above-described step S105 when the above-described rear edge printing process has been performed after interlace printing. In this case, the image is printed by interlace printing until the head comes to the position of the head 41A shown in FIG. 17A, and until then, the paper is carried with a constant carry amount. Then, when the rear edge of the image is to be printed, a change is made from the interlace printing scheme to the rear edge printing process, and the paper is carried with small carry amounts. In this case, the final raster line is formed by the nozzle #180. Therefore, when printing is finished, the nozzle #180 is at the same position, in the carrying direction, as the final raster line. In other words, when printing is finished, the nozzle #180 is positioned further on the downstream side than the pass region.

That is, in this case, the image is formed on the paper in a state in which the rear edge of the paper has not passed the carry roller 23. Accordingly, high-quality printing is possible.

Figure 17B:
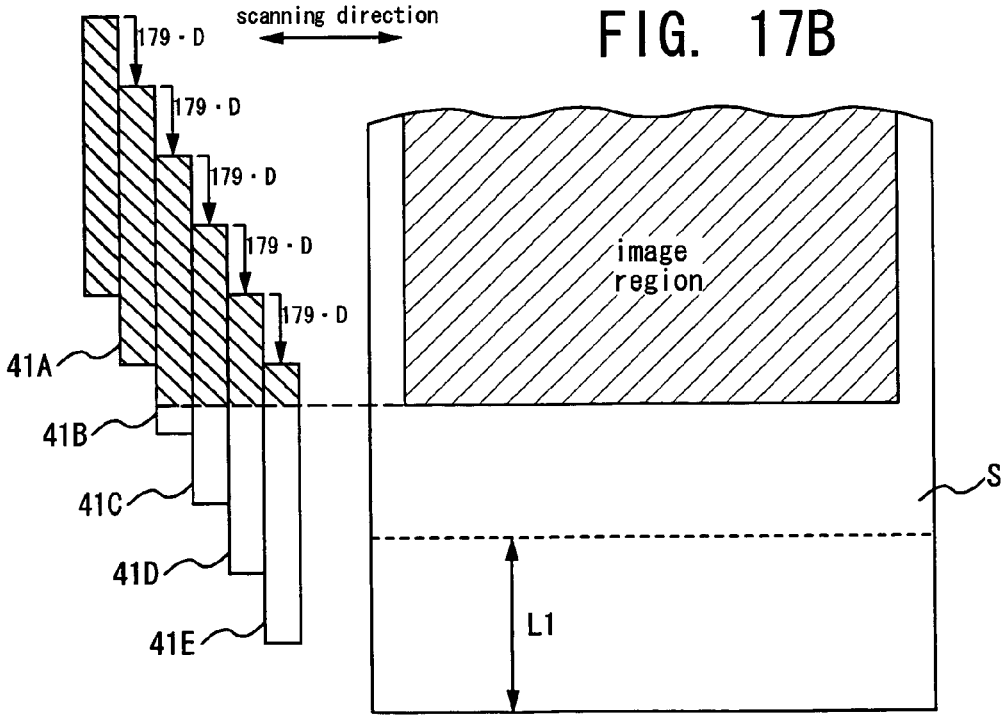
FIG. 17B is for describing a comparative example of this.

FIG. 17B is an explanatory diagram of a comparative example. This example describes a case in which, as shown in FIG. 17B, interlace printing is performed to print the rear edge of the image. In this case, the paper is carried by constant carry amounts. However, when printing is finished, the head is positioned at the position of the head 41E with respect to the paper S. That is, the nozzle #180 is positioned in opposition to the pass region. In other words, in this comparative example, the rear edge of the paper passes the carry roller during the printing of the image. Thus, the paper is carried only by the discharge roller 25 after the rear edge of the paper has passed the carry roller, and therefore, the paper is not carried stably, thereby causing deterioration in image quality.

Accordingly, when the influence of the rear edge of the paper passing the carry roller is a greater cause of image-quality deterioration than the influence of variation in the carry amount due to the rear edge printing process, an image printed as in FIG. 17A has higher quality than an image printed as in FIG. 17B.

<Effect 3 of the Present Embodiment>

Figure 18A:
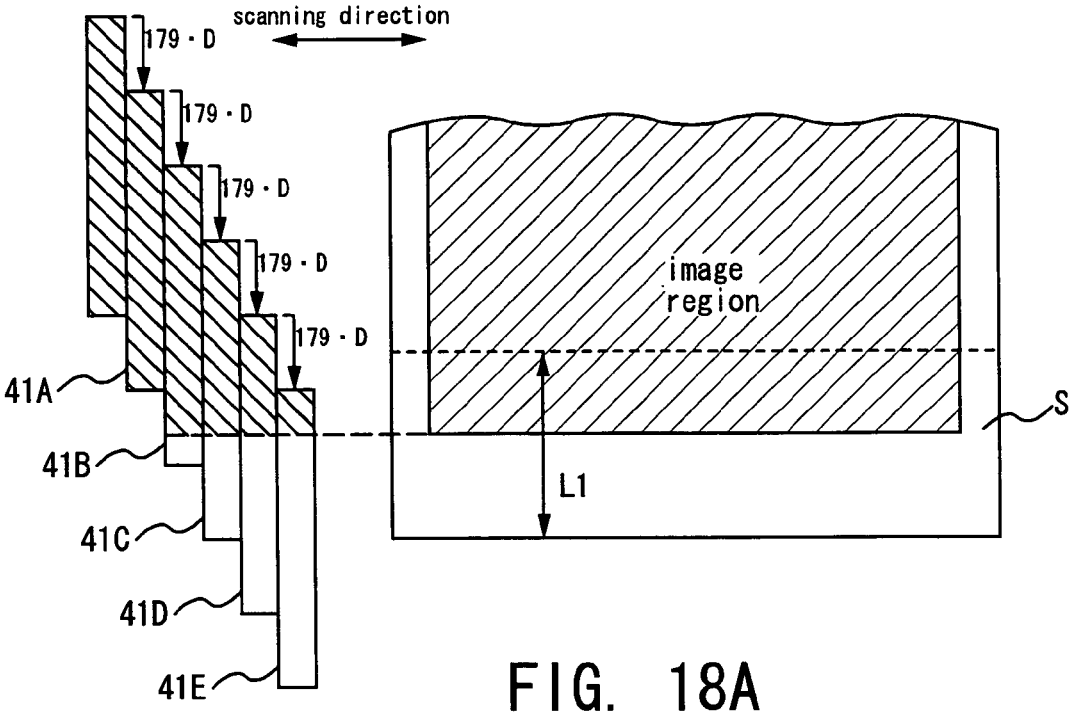
FIG. 18A is an explanatory diagram of a state of printing when interlace printing is continued without performing the rear edge printing process according to step S106.

FIG. 18A is an explanatory diagram showing the state of printing when interlace printing is continued without the rear edge printing process being performed in the above-mentioned step S106. In this case, the paper is carried by constant carry amounts (179·D) and the image is printed on the paper. When printing is finished, the final raster line is in opposition to a portion at approximately one-quarter of the head 41E on the downstream side in the carrying direction. In other words, when printing is finished, the nozzle #180 is positioned within the pass region. This means that the rear edge of the paper has passed the carry roller during the printing of the image. For this reason, image quality is impaired at the rear edge of the image. Note, however, that in this case, there is no change in the carry amount of the paper and printing is performed with a constant carry amount. Thus, it is possible to suppress excessive deterioration of image quality.

Figure 18B:
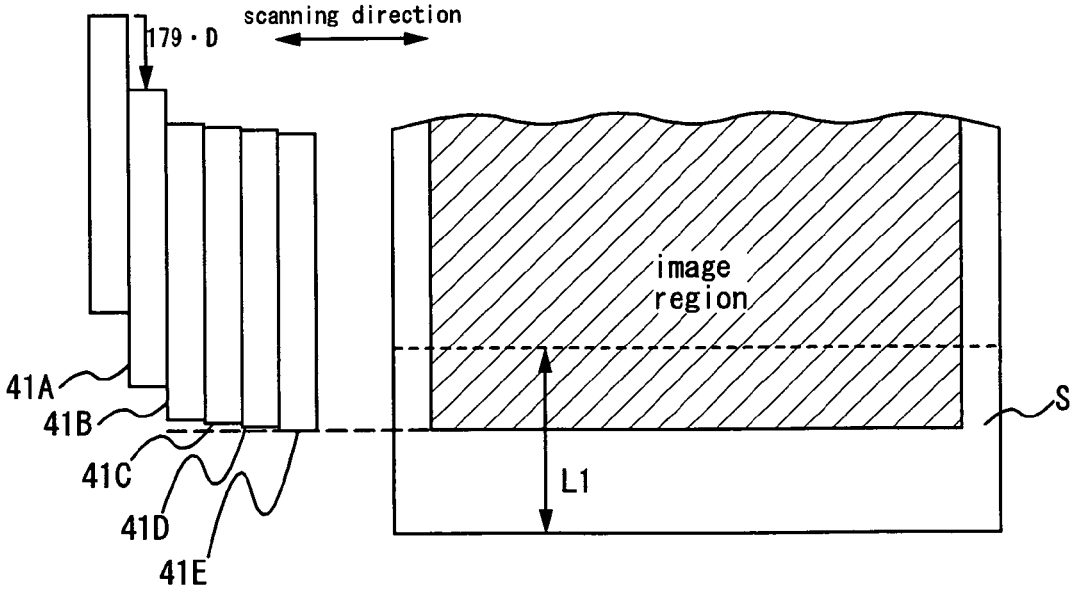
FIG. 18B is for describing a comparative example.

FIG. 18B is an explanatory diagram of a comparative example. This example describes a case in which, as shown in FIG. 18B, the rear edge printing process is performed to print the rear edge of the image. In this case also, as in the case of FIG. 18A, the rear edge of the paper passes the carry roller during the printing of the image. Furthermore, in this case, the carry amount of the paper is also changed during the printing of the image. Put differently, in this case, two causes of image deterioration occur at the same time, and there is excessive deterioration of image quality.

Accordingly, an image printed as in FIG. 18A has higher image quality than an image printed as in FIG. 18B.

Other Embodiments

The foregoing embodiment described primarily a printer. However, it goes without saying that the foregoing description also includes the disclosure of printing apparatuses, recording apparatuses, liquid ejecting apparatuses, printing methods, recording methods, liquid ejecting methods, printing systems, recording systems, computer systems, programs, storage media having programs recorded thereon, display screens, screen display methods, and methods for producing printed matter, for example.

Further, a printer, for example, was described above as an embodiment. However, the foregoing embodiment is for the purpose of elucidating the present invention and is not to be construed as limiting the present invention. The invention can of course be altered and improved without departing from the gist thereof and includes its equivalents. In particular, the implementations mentioned below are also included in the invention.

<(1) Regarding Interlace Printing>

In the foregoing embodiment, regular printing was carried out using interlace printing. However, the regular printing process is not limited to the above-described interlace printing. For example, overlap printing, which is described below, may also be used.

Figure 19A:
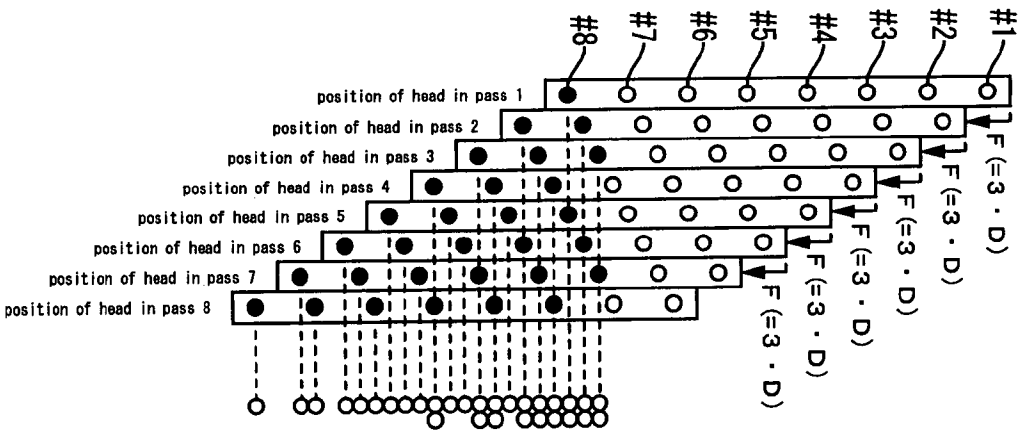
FIGS. 19A and 19B are explanatory diagrams of overlap printing using eight nozzles.
Figure 19B:
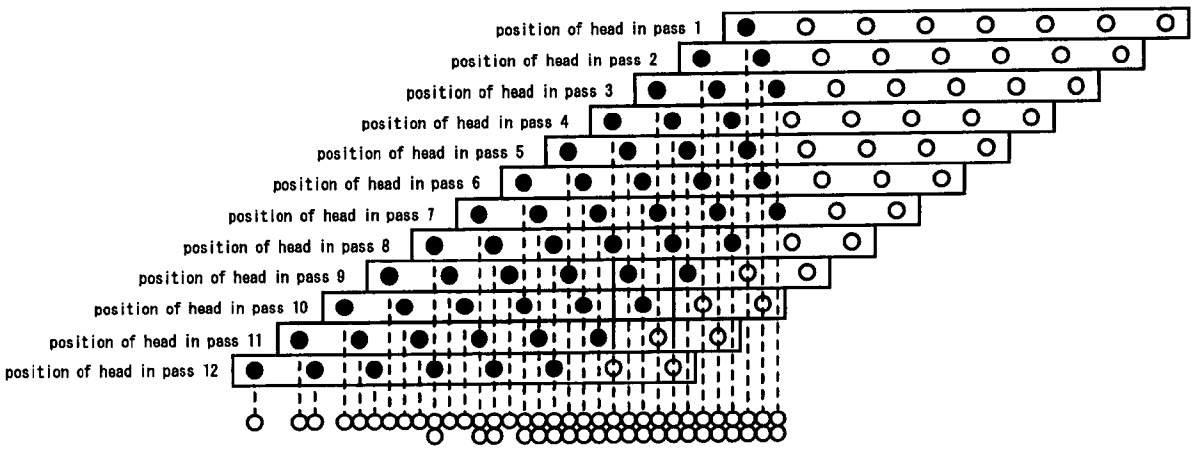

FIGS. 19A and 19B are explanatory diagrams for describing overlap printing using eight nozzles. In the above-described interlace printing, a single raster line is formed by a single nozzle. With overlap printing, however, a single raster line is formed, for example, with two or more nozzles.

In overlap printing, each time the paper is carried by the constant carry amount F in the carrying direction, the nozzles form dots intermittently at intervals of several dots. Then, by causing a different nozzle to form dots in another pass such that the intermittent dots that have already been formed are filled in, a single raster line is completed using a plurality of nozzles. The overlap number M is defined as the number of times of passes needed to complete a single raster line. In these figures, since each nozzle intermittently forms every other dot, dots are formed in every pass at odd-number pixels or even-number pixels. Since a single raster line is formed using two nozzles, the overlap number is M=2. It should be noted that the overlap number is M=1 in the case of interlace printing.

In overlap printing, the following conditions are necessary in order to carry out recording with a constant carry amount:

(1) N/M is an integer, (2) N/M and k are coprime to one another, and (3) the carry amount F is set to (N/M)·D.

In FIGS. 19A and 19B, the nozzle group has eight nozzles arranged in the carrying direction. However, since the nozzle pitch k of the nozzle group is 4, in order to fulfill the condition for performing overlap printing, which is that "N/M and k are coprimes," not all the nozzles can be used. Therefore, six of the eight nozzles are used to perform overlap printing. Furthermore, because six nozzles are used, the paper is carried using a carry amount of 3·D. As a result, using a nozzle group with a nozzle pitch of 180 dpi (4·D) for example, dots are formed on the paper with a dot interval of 720 dpi (=D). Furthermore, in a single pass, each of the relevant nozzles intermittently forms every other dot in the scanning direction. In the figures, a raster line in which two dots have been written in the scanning direction is in a completed state. For example, in FIG. 19A, the raster lines from the first raster line to the sixth raster line are already completed. Raster lines in which only one dot has been written are raster lines in which dots are formed intermittently at every other dot. For example, in the seventh and tenth raster lines, dots are formed intermittently at every other dot. It should be noted that the seventh raster line, in which dots have been intermittently formed at every other dot, will be completed by having the nozzle #1 form dots to fill the line up in the ninth pass.

It should be noted that, from the seventh pass on, six nozzles (#3 to #8) eject ink and the paper is carried by a constant carry amount F (=3·D) to form continuous raster lines with the dot interval D.

Figure 20A:
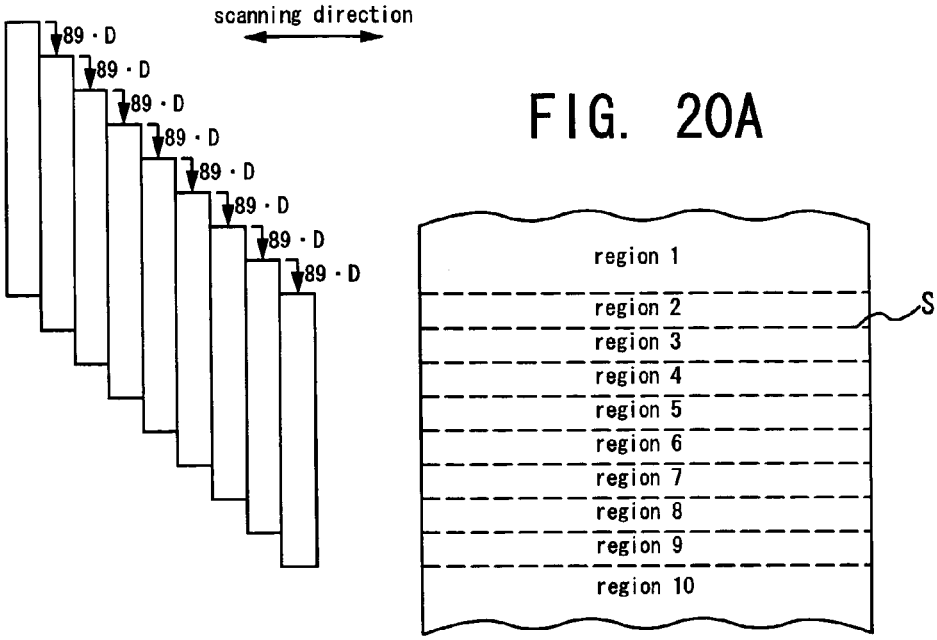
FIG. 20A is an explanatory diagram of actual overlap printing.
Figure 20B:
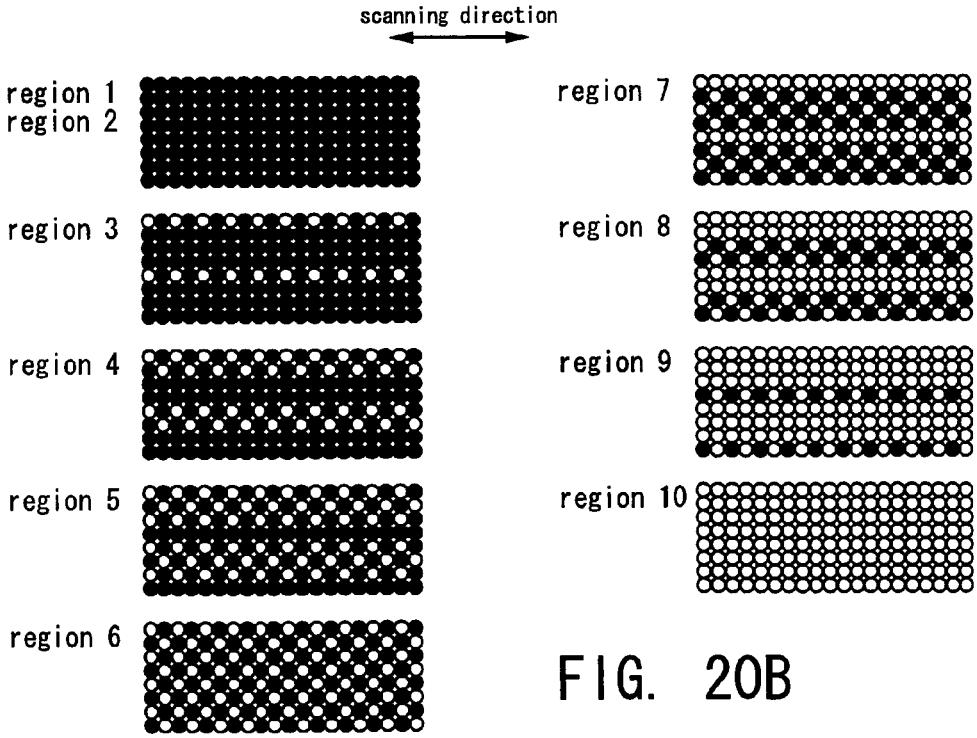
FIG. 20B is an explanatory diagram of the dot formation condition in various regions.

FIG. 20A is an explanatory diagram describing overlap printing when using 180 nozzles. FIG. 20B is an explanatory diagram of the dot formation condition in various regions. When there are 180 nozzles, 178 nozzles are used and the paper is carried with a constant carry amount of 89·D.

Also with overlap printing, the dots for all the pixels of a region in opposition to the head are not formed in a single scan (in only one pass) of the head. Specifically, to form dots for all the pixels of a given region, it is necessary to make eight passes (k×M times). When dots are formed for all the pixels in a given region, that region is carried up to a position in opposition to a portion at approximately one-eighth of the head 41 on the downstream side in the carrying direction.

It is possible to achieve the same effects as the above embodiment by performing the above-described overlap printing instead of the interlace printing in the foregoing embodiment. It should be noted that overlap printing is a printing scheme that is also encompassed in the concept of interlace printing, since there is a not-recorded raster line sandwiched between raster lines that have been recorded in one pass.

<(2) Regarding Interlace Printing>

In the foregoing embodiment, interlace printing was performed using a nozzle group with a nozzle pitch of 180 dpi (4·D). However, interlace printing is not limited to this. For example, it is also possible to perform interlace printing using a nozzle group with a nozzle pitch of 720 dpi (D).

Figure 21:
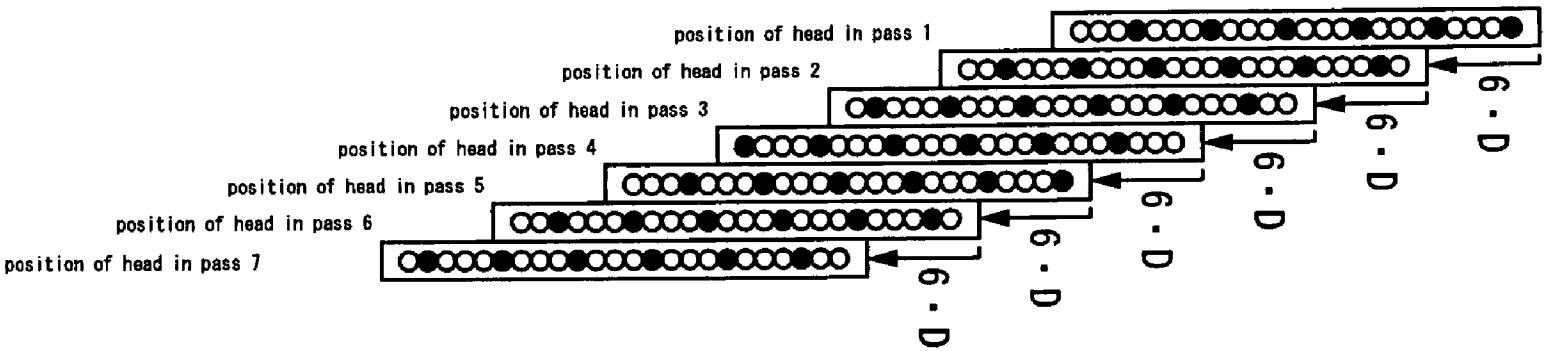
FIG. 21 is an explanatory diagram of another type of interlace printing.

FIG. 21 is an explanatory diagram of another type of interlace printing. In this embodiment, a plurality of nozzles of a nozzle group are arranged in the carrying direction at 720 dpi (=1/720 inch). When dots are formed on the paper with a 720 dpi interval, then k=1. To simplify description in the present embodiment, the nozzle group has 24 nozzles. Also, the paper is carried by a constant interval of 4·D. Furthermore, ink is ejected from every fourth nozzle and the nozzles that eject ink are changed per every pass.

Also in the present embodiment, it is possible to perform interlace printing such that there is a not-recorded raster line sandwiched between raster lines that have been recorded in a single pass. Furthermore, with the present embodiment, there is no restriction such as "the number N (integer) of nozzles that can eject ink must be coprime to k" such as in the foregoing embodiment (however, there are other restrictions).

<Regarding Rear Edge Printing Process>

In the foregoing embodiment, the paper was carried with a carry amount D equivalent to the dot pitch when printing the rear edge of the image. However, the carry amount of the paper for the rear edge printing process is not limited to this. That is to say, the same effect can be achieved as long as it is a printing process in which paper is carried by a carry amount that is smaller than the carry amount during regular printing processing.

For example, if interlace printing is performed by reducing the number of nozzles used from 179 nozzles to 47 nozzles when printing the rear edge of the image, then the carry amount changes from 179·D to 47·D. In this way, the same effect can be achieved by performing interlace printing with a reduced number of nozzles, since the paper is carried by a carry amount smaller than that during regular printing processing. However, in this case, the positions of the "determination region" and the "pass region" vary in accordance with the carry amount of the rear edge printing process. For example, with interlace printing in which printing is performed with a carry amount of 47·D, the positions of the "determination region" and the "pass region" become positioned further on the downstream side in the carrying direction than in the foregoing embodiment (i.e., the area of the "determination region" and the "pass region" becomes larger). This is because the carry amount for the rear edge printing process is larger than the carry amount in the foregoing embodiment.

<Regarding the Position of the Final Raster Line>

In the foregoing embodiment, the position of the final raster line on the paper was calculated according to information about the size of the paper. However, calculation of the position of the final raster line on the paper is not limited to this.

For example, it is also possible to calculate the position of the final raster line on the paper according to the detection result of the paper detection sensor 53 and the number of raster lines remaining when the rear edge of the paper passes the paper detection sensor 53. That is, the distance from the paper detection sensor 53 to the carry roller 23 is a known dimension of the printer. After the rear edge of the paper passes the paper detection sensor 53, the rear edge of the paper will then pass the carry roller if the carry unit carries the paper by this distance. Put differently, the "determination region" and the "pass region" are defined according to the detection result of the paper detection sensor 53. Accordingly, it is possible to determine whether to perform "interlace printing" or the "rear edge printing process" according to the positions of the "determination region" and the "pass region", which have been defined in accordance with the paper detection sensor 53, and the position of the final raster line.

In this way, even if the size of the paper that is input to the printer driver is different from the actual size of the paper, it is possible to ensure that the printing scheme is selected correctly since the timing at which the rear edge of the paper passes the carry roller is ascertained.

<Regarding Selection of the Printing Scheme>

In the foregoing embodiment, the decision of whether to perform interlace printing or whether to perform the rear edge printing process was made by a printer driver installed on the computer. However, the element selecting the printing scheme is not limited to this.

For example, the controller of the printer may carry out the selection of the printing scheme.

<Regarding the Printer>

In the above embodiment, a printer was described. This, however, is not a limitation. It is possible to apply a similar technique as in the present embodiment to a variety of recording apparatuses that utilize inkjet technology such as color filter manufacturing apparatuses, dying apparatuses, fine processing apparatuses, semiconductor manufacturing apparatuses, surface processing apparatuses, three-dimensional molding machines, fluid gasification apparatuses, organic EL manufacturing apparatuses (particularly macromolecular EL manufacturing apparatuses), display manufacturing apparatuses, film forming apparatuses, and DNA chip manufacturing apparatuses. Furthermore, methods for these apparatuses and manufacturing methods are also within the scope of application. If the present technique is utilized in fields such as these, it is possible to achieve a reduction in materials, processes, and costs compared to conventional printing techniques because the present technique is characterized by directly ejecting (rendering) a liquid toward a target object.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject, from the nozzles, a liquid (including water) including metallic materials, organic materials (particularly macromolecular materials), magnetic materials, conductive materials, wiring materials, film-formation materials, electronic ink, processing liquid or genetic solutions. A reduction in materials, processes, and costs can be achieved if such liquids are directly ejected toward a target object.

<Regarding the Nozzles>

In the foregoing embodiment, ink was ejected using piezoelectric elements. However, the method for ejecting liquid is not limited to this. Other methods may also be employed, such as a method for generating bubbles in the nozzles through heat.

Summary (1) In the foregoing embodiment, the printing apparatus (a printing apparatus in the broad sense or the narrow sense) is provided with a carry roller (carrying member) that carries a paper (medium) in a carrying direction toward a print region. The carry roller is positioned upstream in the carrying direction with respect to the print region. The printing apparatus can perform interlace printing (a first printing process in which the carrying member carries the medium by a predetermined carry amount and an image is printed on the medium positioned at the print region) and a rear edge printing process (a second printing process in which the carrying member carries the medium by a carry amount that is smaller than the carry amount of the first printing process and an image is printed on the medium positioned at the print region).

With such a printing apparatus, if printing were to be carried out using only interlace printing for any kind of image, then the rear edge of the paper would pass the carry roller during printing if the image to be printed is large, thus resulting in image deterioration.

Furthermore, with such a printing apparatus, if the rear edge printing process were to be performed after interlace printing for any kind of image, then image deterioration would occur since the carry amount would be changed even when the rear edge of the paper does not pass the carry roller during printing.

For this reason, in the foregoing embodiment, interlace printing or the rear edge printing process is selected by the printer driver or the controller of the printer (controller) according to the position of the final raster line (rear edge of the image) on the paper.

In this way, it is possible for the printer driver, for example, to carry out selection of the printing scheme using the position at which the rear edge of the paper passes the carry roller as a reference. The result of this is that the printing apparatus can perform high-quality printing.

(2) In the foregoing embodiment, if the position of the final raster line (rear edge of the image) on the paper (on the medium) is at a position from the rear edge of the paper further than the distance of L1+L2 (i.e., further downstream in the carrying direction than the first position), the printer driver or the like selects interlace printing as the printing process for printing the rear edge of the image on the paper.

If the final raster line is in such a position, printing is performed with a constant carry amount since the rear edge of the paper does not pass the carry roller at the completion of printing even when printing is carried out using only interlace printing. Thus, high-quality printing can be performed.

(3) In the foregoing embodiment, if the position of the final raster line (rear edge of the image) on the paper (on the medium) is in a position of not more than the distance of L1+L2 from the rear edge of the paper (i.e., further upstream in the carrying direction than the first position) and a position that is at least the distance L1 from the rear edge of the paper (further downstream in the carrying direction than the second position), then the printer driver or the like selects the rear edge printing process as the printing process for printing the final raster line on the paper.

If the final raster line is in such a position, the rear edge of the paper will pass the carry roller during printing when printing is carried out using only interlace printing. On the other hand, if a transition is made during printing from interlace printing to the rear edge printing process, then the rear edge of the paper does not pass the carry roller at the time when printing is finished. Accordingly, very high-quality printing can be performed when the influence of the rear edge of the paper passing the carry roller is a greater cause of image-quality deterioration than the influence of variation in the carry amount due to the rear edge printing process.

(4) In the foregoing embodiment, if the position of the final raster line (rear edge of the image) on the paper (on the medium) is in a position that is not more than the distance L1 from the rear edge of the paper (i.e., further upstream in the carrying direction than the second position), then the printer driver or the like selects the interlace printing when printing the final raster line on the paper.

If the final raster line is in such a position, since the rear edge of the paper passes the carry roller no matter which printing process is performed, it is possible to suppress excessive deterioration of image quality by not changing the carry amount of the paper and performing printing with a constant carry amount.

(5) In the foregoing embodiment, the printing apparatus is further provided with a plurality of nozzles lined up in the carrying direction. The position (first position) of L1+L2 from the rear edge of the paper is a position on the paper in opposition to the nozzle #1 (nozzle positioned furthest downstream in the carrying direction) when the rear edge of the paper passes the carry roller (carrying member).

By comparing this position with the position of the final raster line, the printer driver can determine whether or not the rear edge of the paper will pass the carry roller.

However, the first position is not limited to this. For example, if a rear edge printing process different from that described in the foregoing embodiment is carried out, the first position can change in accordance with that carry amount or printing scheme for instance.

(6) In the foregoing embodiment, the position (second position) of L1 from the rear edge of the paper is a position on the paper in opposition to the nozzle #180 (nozzle positioned furthest upstream in the carrying direction) when the rear edge of the paper passes the carry roller.

By comparing this position with the position of the final raster line, the printer driver can determine whether or not the rear edge of the paper will pass the carry roller.

However, the second position is not limited to this. For example, if a rear edge printing process different from that described in the foregoing embodiment is carried out, the second position can change in accordance with that carry amount or printing scheme for instance.

(7) In the foregoing embodiment, the paper is carried by a carry amount D equivalent to the dot pitch (i.e., the interval, in the carrying direction, between dots formed on the paper) in the rear edge printing process (second printing process).

In this way, the positions used as a reference when selecting the printing process are determined to be positions such as those shown in FIG. 14B.

However, as already stated, the carry amount in the rear edge printing process is not limited to D.

(8) In the foregoing embodiment, the regular printing process (first printing process) is the interlace printing process. That is, a not-recorded raster line is sandwiched between raster lines that are recorded in one pass in the regular printing process. Because of such a printing process, there is a distance between the rear edge of the image and the nozzle #180 when printing is finished, so that the rear edge of the paper tends to pass the carry roller.

However, the regular printing process is not limited to interlace printing. For example, the regular printing process may be band printing (a printing scheme in which continuous raster lines are formed in a single pass). That is to say, the same effect as the foregoing embodiment can be achieved as long as the carry amount of the regular printing process is greater than the carry amount of the rear edge printing process.

(9) In the foregoing embodiment, the position of the final raster line (rear edge of the image) on the paper is determined according to the size of the paper. Specifically, as shown in FIG. 15, the printer driver calculates the position L of the final raster line on the paper according to the paper size PL, the image size H, and the margin T. It should be noted that information about the paper size PL and information about the margin T are input to the printer driver via the user interface when the user performs settings for the printer driver. Furthermore, information about the image size H can be calculated based on the image data received from the application software.

(10) In the foregoing embodiment, a paper detection sensor (sensor that detects the rear edge of the medium) is provided further upstream in the carrying direction than the carry roller (carrying member). Further, the position of the final raster line (rear edge of the image) on the paper is determined according to the detection result of the paper detection sensor.

In this way, even if the size of the paper that is input into the printer driver is different from the actual size of the paper, it is possible to ensure that the printing scheme is selected correctly since the timing at which the rear edge of the paper passes the carry roller is ascertained.

(11) In the foregoing embodiment, a paper discharge roller (medium-discharge member), which carries the paper (medium) in the carrying direction, is provided further downstream in the carrying direction than the print region. After the rear edge of the paper has passed the carry roller (carrying member), the paper discharge roller carries the paper in the carrying direction.

After the rear edge of the paper has passed the carry roller, the state becomes different from the state (regular carrying state) in which the paper is carried by two rollers since the paper is carried only by the paper discharge roller. As a result, the dots that are formed after the rear edge of the paper has passed the carry roller are displaced in the carrying direction with respect to dots that were formed before the rear edge of the paper passes the carry roller. As a result, bands that extend in the scanning direction are caused between the image printed before the rear edge of the paper passes the carry roller and the image printed after the rear edge of the paper has passed the carry roller, thus resulting in image deterioration.

In such a configuration, it is preferable that, to the greatest extent possible, printing is performed such that the rear edge of the paper does not pass the carry roller. According to the foregoing embodiment, even in cases where the rear edge of the paper will pass the carry roller if interlace printing is performed, the rear edge printing process will instead be selected if the rear edge of the paper will not pass the carry roller when the rear edge printing process is performed. Therefore, image deterioration can be suppressed.

(12) In the foregoing embodiment, the paper discharge roller (medium-discharge member) has a different shape than the carry roller (carrying member). For this reason, after the rear edge of the paper passes the carry roller, the carrying state differs from the regular carry state, thus causing image deterioration.

In such a configuration, it is preferable that, to the greatest extent possible, printing is performed such that the rear edge of the paper does not pass the carry roller. According to the foregoing embodiment, even in cases where the rear edge of the paper will pass the carry roller if interlace printing is performed, the rear edge printing process will instead be selected if the rear edge of the paper will not pass the carry roller when the rear edge printing process is performed. Therefore, image deterioration can be suppressed.

(13) In the foregoing embodiment, a printing apparatus that included all the aforementioned structural elements was described However, it is not necessary that all the aforementioned structural elements are included. That is to say, it is only necessary that a controller selects either the first printing process or the second printing process according to the position of the final raster line (rear edge of the image) on the paper.

In this way, the printer driver, for example, can carry out the selection of the printing scheme using the position at which the rear edge of the paper passes the carry roller as a reference. As a result, the printing apparatus can perform high-quality printing.

(14) In the foregoing embodiment, not only a printing apparatus, but a printing method was also disclosed. It goes without saying that high-quality printing can be performed with this printing method.

(15) In the foregoing embodiment, not only a printing apparatus, but a program was also disclosed. This program is, for example, a printer driver installed on the computer, or a program stored in a memory on the printer side. This program causes a printing apparatus (a printing apparatus in the broad sense or the narrow sense), which is provided with a carry roller (carrying member) positioned upstream in the carrying direction with respect to the print region, to execute interlace printing (a first printing process in which the carrying member carries the medium by a predetermined carry amount and an image is printed on the medium positioned in the print region) and a rear edge printing process (a second printing process in which the carrying member carries the medium by a carry amount smaller than the carry amount of the first printing process and an image is printed on the medium positioned in the print region). Furthermore, in the foregoing embodiment, the program causes the printing apparatus to execute a function in which either interlace printing or the rear edge printing process is selected according to the position of the final raster line (rear edge of the image) on the paper (on the medium).

In this way, the printing apparatus can be controlled such that the printing apparatus performs high-quality printing on the paper.

What is claimed is:

1. A printing method for printing an image on a medium, comprising the steps of:

performing a first printing process, wherein in said first printing process, said medium is carried in a carrying direction by a predetermined carry amount and an image is printed on said medium that is positioned at a print region, and wherein a carrying member used for carrying said medium is positioned upstream in said carrying direction with respect to said print region; and selecting either said first printing process or a second printing process according to a distance between a rear edge of said image and a rear edge of said medium as a printing process for printing said rear edge of said image on said medium, wherein in said second printing process, said medium is carried by a carry amount that is smaller than said carry amount of said first printing process and said image is printed on said medium that is positioned at said print region wherein, if the position of said rear edge of said image on said medium is further upstream in said carrying direction than a first position and further downstream in said carrying direction than a second position, then said second printing process is selected as the printing process for printing said rear edge of said image on said medium, and wherein, if the position of said rear edge of said image on said medium is further upstream in said carrying direction than said second position, then said first printing process is selected as the printing process for printing said rear edge of said image on said medium.

2. A printing method according to claim 1, wherein if the position of said rear edge of said image on said medium is further downstream in said carrying direction than said first position, then said first printing process is selected as the printing process for printing said rear edge of said image on said medium.

3. A printing method according to claim 2, wherein said first position is a position on said medium that is in opposition to a nozzle positioned furthest downstream in said carrying direction, among a plurality of nozzles lined up in said carrying direction, when a rear edge of said medium passes said carrying member.

4. A printing method according to claim 2, wherein said second position is a position on said medium that is in opposition to a nozzle positioned furthest upstream in said carrying direction, among a plurality of nozzles lined up in said carrying direction, when a rear edge of said medium passes said carrying member.

5. A printing method according to claim 4, wherein in said second printing process, said medium is carried by a carry amount equivalent to an interval, in said carrying direction, between dots formed on said medium.

6. A printing method according to claim 1, wherein said first printing process is an interlace printing process.

7. A printing method according to claim 1, wherein the position of said rear edge of said image on said medium is determined according to a size of said medium.

8. A printing method according to claim 1, wherein:

a rear edge of said medium is detected further upstream in said carrying direction than said carrying member; and the position of said rear edge of said image on said medium is determined according to a result of detecting said rear edge of said medium.

9. A printing method according to claim 1, wherein after a rear edge of said medium has passed said carrying member, said medium is carried in said carrying direction by a medium-discharge member positioned further downstream in said carrying direction than said print region.

10. A printing method according to claim 9, wherein said medium-discharge member has a different shape than said carrying member.

11. A printing method for printing an image on a medium, comprising the steps of:

performing a first printing process, wherein in said first printing process, said medium is carried in a carrying direction by a predetermined carry amount and an image is printed on said medium that is positioned at a print region, and wherein a carrying member used for carrying said medium is positioned upstream in said carrying direction with respect to said print region; and selecting either said first printing process or a second printing process according to a distance between a rear edge of said image and a rear edge of said medium as a printing process for printing said rear edge of said image on said medium, wherein in said second printing process, said medium is carried by a carry amount that is smaller than said carry amount of said first printing process and said image is printed on said medium that is positioned at said print region;

wherein, if the position of said rear edge of said image with respect to the position of a rear edge of said medium is further downstream in said carrying direction than a first position, then said first printing process is selected as the printing process for printing said rear edge of said image on said medium;

wherein, if the position of said rear edge of said image with respect to the position of a rear edge of said medium is further upstream in said carrying direction than said first position and further downstream in said carrying direction than a second position, then said second printing process is selected as the printing process for printing said rear edge of said image on said medium;

wherein, if the position of said rear edge of said image with respect to the position of a rear edge of said medium is further upstream in said carrying direction than said second position, then said first printing process is selected as the printing process for printing said rear edge of said image on said medium;

wherein said first position is a position with respect to the position of a rear edge of said medium that is in opposition to a nozzle positioned furthest downstream in said carrying direction, among a plurality of nozzles lined up in said carrying direction, when a rear edge of said medium passes said carrying member;

wherein said second position is a position with respect to the position of a rear edge of said medium that is in opposition to a nozzle positioned furthest upstream in said carrying direction, among a plurality of nozzles lined up in said carrying direction, when said rear edge of said medium passes said carrying member;

wherein, in said second printing process, said medium is carried by a carry amount equivalent to an interval, in said carrying direction, between dots formed on said medium;

wherein said first printing process is an interlace printing process;

wherein the position of said rear edge of said image with respect to the position of a rear edge of said medium is determined according to a size of said medium;

wherein said rear edge of said medium is detected further upstream in said carrying direction than said carrying member;

wherein the position of said rear edge of said image with respect to the position of a rear edge of said medium is determined according to a result of detecting said rear edge of said medium;

wherein, after said rear edge of said medium has passed said carrying member, said medium is carried in said carrying direction by a medium-discharge member positioned further downstream in said carrying direction than said print region; and wherein said medium-discharge member has a different shape than said carrying member.

12. A printing apparatus for printing an image on a medium, comprising:

a carry unit, said carry unit being provided with a carrying member positioned upstream in a carrying direction with respect to a print region, and carrying said medium in said carrying direction; and a controller, said controller performing a first printing process in which said medium is carried by said carrying member by a predetermined carry amount and an image is printed on said medium that is positioned at said print region, and selecting either said first printing process or a second printing process according to a distance between a rear edge of said image and a rear edge of said medium as the printing process for printing said rear edge of said image on said medium, wherein in said second printing process, said medium is carried by said carrying member by a carry amount that is smaller than said carry amount of said first printing process and said image is printed on said medium that is positioned at said print regions, wherein, if the position of said rear edge of said image on said medium is further upstream in said carrying direction than a first position and further downstream in said carrying direction than a second position, then said second printing process is selected as the printing process for printing said rear edge of said image on said medium, and wherein if the position of said rear edge of said image on said medium is further upstream in said carrying direction than said second position, then said first printing process is selected as the printing process for printing said rear edge of said image on said medium.

* * * * *